US008743164B2

(12) United States Patent
Iguchi et al.

(10) Patent No.: US 8,743,164 B2
(45) Date of Patent: Jun. 3, 2014

(54) IMAGE ERASING APPARATUS AND IMAGE ERASING METHOD

(75) Inventors: Ken Iguchi, Shizuoka-ken (JP); Hidetoshi Yokochi, Shizuoka-ken (JP); Isao Yahata, Shizuoka-ken (JP); Takahiro Kawaguchi, Shizuoka-ken (JP); Yoshiaki Sugizaki, Shizuoka-ken (JP); Kikuo Mizutani, Shizuoka-ken (JP); Hiroyuki Taki, Shizuoka-ken (JP); Hiroyuki Tsuchihashi, Shizuoka-ken (JP); Chiaki Ilzuka, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/486,769

(22) Filed: Jun. 1, 2012

(65) Prior Publication Data

US 2012/0306985 A1 Dec. 6, 2012

Related U.S. Application Data

(60) Provisional application No. 61/492,805, filed on Jun. 2, 2011, provisional application No. 61/494,850, filed on Jun. 8, 2011, provisional application No. 61/494,847, filed on Jun. 8, 2011, provisional application No. 61/494,856, filed on Jun. 8, 2011, provisional application No. 61/495,274, filed on Jun. 9, 2011.

(30) Foreign Application Priority Data

Sep. 26, 2011 (JP) ..... P2011-208903
Sep. 28, 2011 (JP) ..... P2011-211811
Nov. 4, 2011 (JP) ..... P2011-241977

(51) Int. Cl.
*B41J 29/16* (2006.01)

(52) U.S. Cl.
USPC ..... 347/179

(58) Field of Classification Search
USPC ..... 347/171, 179, 222
See application file for complete search history.

(56) References Cited

U.S. PATENT DOCUMENTS 5,545,381 A 8/1996 Iida et al.
6,236,831 B1 5/2001 Mei et al.

(Continued)

FOREIGN PATENT DOCUMENTS

EP 0523705 1/1993
EP 2287005 2/2011

(Continued)

OTHER PUBLICATIONS

European Search Report Reference F23287, mailed Jan. 30, 2013, in corresponding European Application No. 12169159.6, 7 pages.

(Continued)

*Primary Examiner* — Kristal Feggins
(74) *Attorney, Agent, or Firm* — Patterson & Sheridan, L.L.P.

(57) ABSTRACT

According to one embodiment, a first conveying path to form a conveying path from a sheet supply portion toward an ejector, a reader arranged on the first conveying path to read an image on a surface of the sheet, an erasure to erase the image on the sheet formed with image erasable material, a switching portion arranged on the first conveying path at a downstream side of the reader in a sheet conveying direction to switch the sheet conveying direction to a direction of the ejector or a direction of the erasure, and a second conveying path having the erasure which, at a position where the switching portion is arranged, branches from the first conveying path at the downstream side of the reader and merges with the first conveying path at a meeting point between the sheet supply portion and the reader.

20 Claims, 22 Drawing Sheets

(56) References Cited

U.S. PATENT DOCUMENTS

| | | | | |
|---|---|---|---|---|
| 8,289,353 | B2 * | 10/2012 | Taguchi et al. | 347/179 |
| 8,441,508 | B2 * | 5/2013 | Taki et al. | 347/179 |
| 2010/0118361 | A1 | 5/2010 | Iguchi | |
| 2010/0128327 | A1 | 5/2010 | Maeshima et al. | |
| 2010/0194839 | A1 | 8/2010 | Taguchi et al. | |
| 2011/0222131 | A1 | 9/2011 | Yahata et al. | |
| 2011/0234736 | A1 * | 9/2011 | Taguchi et al. | 347/179 |

FOREIGN PATENT DOCUMENTS

| | | | |
|---|---|---|---|
| JP | H06-99644 | A | 4/1994 |
| JP | H07-168489 | | 7/1995 |
| JP | 2001-027868 | | 1/2001 |
| JP | 2001-335218 | A | 12/2001 |
| JP | 2002245075 | | 8/2002 |
| JP | 2003-330597 | A | 11/2003 |
| JP | 2005-159729 | A | 6/2005 |
| JP | 2010-076418 | | 4/2010 |
| JP | 2010-094960 | | 4/2010 |
| JP | 2010-113337 | | 5/2010 |
| JP | 2010-114807 | | 5/2010 |
| JP | 2010113337 | | 5/2010 |
| JP | 2010-141674 | | 6/2010 |

OTHER PUBLICATIONS

English translation of Japanese Office Action, dated Aug. 29, 2013, filed in Japanese counterpart Patent Application No. 2011-208903.

English translation of Japanese Office Action, dated Aug. 29, 2013, filed in Japanese counterpart Patent Application No. 2011-241977.

* cited by examiner

| FUNCTION \ SETTING ITEM | DATA STORING | PRELIMINARY DISCRIMINATION | COLOR ERASING | DISCRIMINATION |
|---|---|---|---|---|
| READING | ON | OFF | OFF | OFF |
| PRELIMINARY DISCRIMINATION | OFF | ON | OFF | OFF |
| COLOR ERASING | OFF | OFF | ON | OFF |
| DISCRIMINATION | OFF | OFF | OFF | ON |
| READING / COLOR ERASING | ON | OFF | ON | OFF |
| COLOR ERASING / DISCRIMINATION | OFF | OFF | ON | ON |
| READING / COLOR ERASING / DISCRIMINATION | ON | OFF | ON | ON |
| READING / PRELIMINARY DISCRIMINATION | ON | ON | OFF | OFF |
| PRELIMINARY DISCRIMINATION / COLOR ERASING | OFF | ON | ON | OFF |
| READING / PRELIMINARY DISCRIMINATION / COLOR ERASING | ON | ON | ON | OFF |
| PRELIMINARY DISCRIMINATION / COLOR ERASING / DISCRIMINATION | OFF | ON | ON | ON |
| READING / PRELIMINARY DISCRIMINATION / COLOR ERASING / DISCRIMINATION | ON | ON | ON | ON |

FIG. 8

IMAGE ERASING APPARATUS AND IMAGE ERASING METHOD

CROSS-REFERENCE TO RELATED APPLICATIONS

This application is based upon and claims the benefit of priority from the prior U.S. patent applications No. 61/492,805, filed on Jun. 2, 2011, No. 61/494,847, filed on Jun. 8, 2011, No. 61/494,850, filed on Jun. 8, 2011, No. 61/494,856, filed on Jun. 8, 2011 and No. 61/495,274 filed on Jun. 9, 2011, the entire contents of which are incorporated herein by reference.

This application is also based upon and claims the benefit of priority from the prior Japanese Patent Applications No. 2011-208903, filed on Sep. 26, 2011, No. 2011-211811, filed on Sep. 28, 2011 and No. 2011-241977, filed on Nov. 4, 2011, the entire contents of which are incorporated herein by reference.

FIELD

Exemplary embodiments described herein relate to an image erasing apparatus and an image erasing method to erase color of an image on a sheet which an image forming apparatus has formed.

BACKGROUND

There is an image erasing apparatus to perform image erasing processing for a sheet with heat to thereby erase color of an image. The image erasing apparatus has an erasure to give heating treatment to a sheet on which an image has been formed with image erasable material to thereby erase the color of the sheet-like image (color material). The image erasing apparatus has a reader to read an image so as to remain image data before image erasing and a reader to read an image so as to discriminate whether or not the image erasing has normally been performed after image erasing. But if the reader to read the image so as to remain the image data and the reader to read the image so as to discriminate whether or not the sheet is reusable after image erasing are separately provided, a problem to cause cost increase occurs. In addition, in case that only the reading processing is performed, if a sheet passes through the erasure, a problem that a long processing time is required occurs.

BRIEF DESCRIPTION OF THE DRAWINGS

FIG. 8 is a table showing the relation between a setting item and a mode;

DETAILED DESCRIPTION

In general, according to one embodiment, there is provided an image erasing apparatus including: a sheet supply portion to supply a sheet; an ejector to which the sheet is ejected; a first conveying path to form a conveying path from the sheet supply portion toward the ejector; a reader arranged on the first conveying path to read an image on a surface of the sheet; an erasure to erase the image on the sheet formed with image erasable material; a switching portion arranged on the first conveying path at a downstream side of the reader in a sheet conveying direction to switch the sheet conveying direction to a direction of the ejector or a direction of the erasure; and a second conveying path having the erasure which, at a position where the switching portion is arranged, branches from the first conveying path at the downstream side of the reader and merges with the first conveying path at a meeting point between the sheet supply portion and the reader.

Hereinafter, embodiments of an image erasing apparatus will be described with reference to the accompanied drawings.

(First Embodiment) An image erasing apparatus of a first embodiment reads images by the same reader before and after erasing the image.

Figure 1:
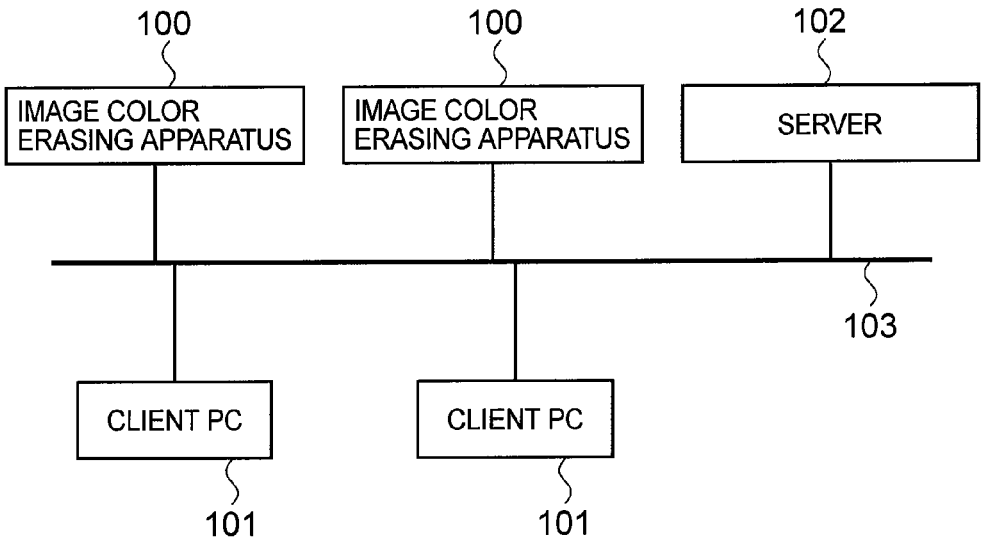
FIG. 1 is a block diagram showing a system in a first embodiment.

FIG. 1 is a system configuration diagram of the first embodiment. An image memory system has a plurality of image erasing apparatuses 100, a plurality of client PCs (Personal Computer) 101, and a server 102, as the system configuration, for example. In addition, the respective components of the system are connected through a network 103.

Figure 2:
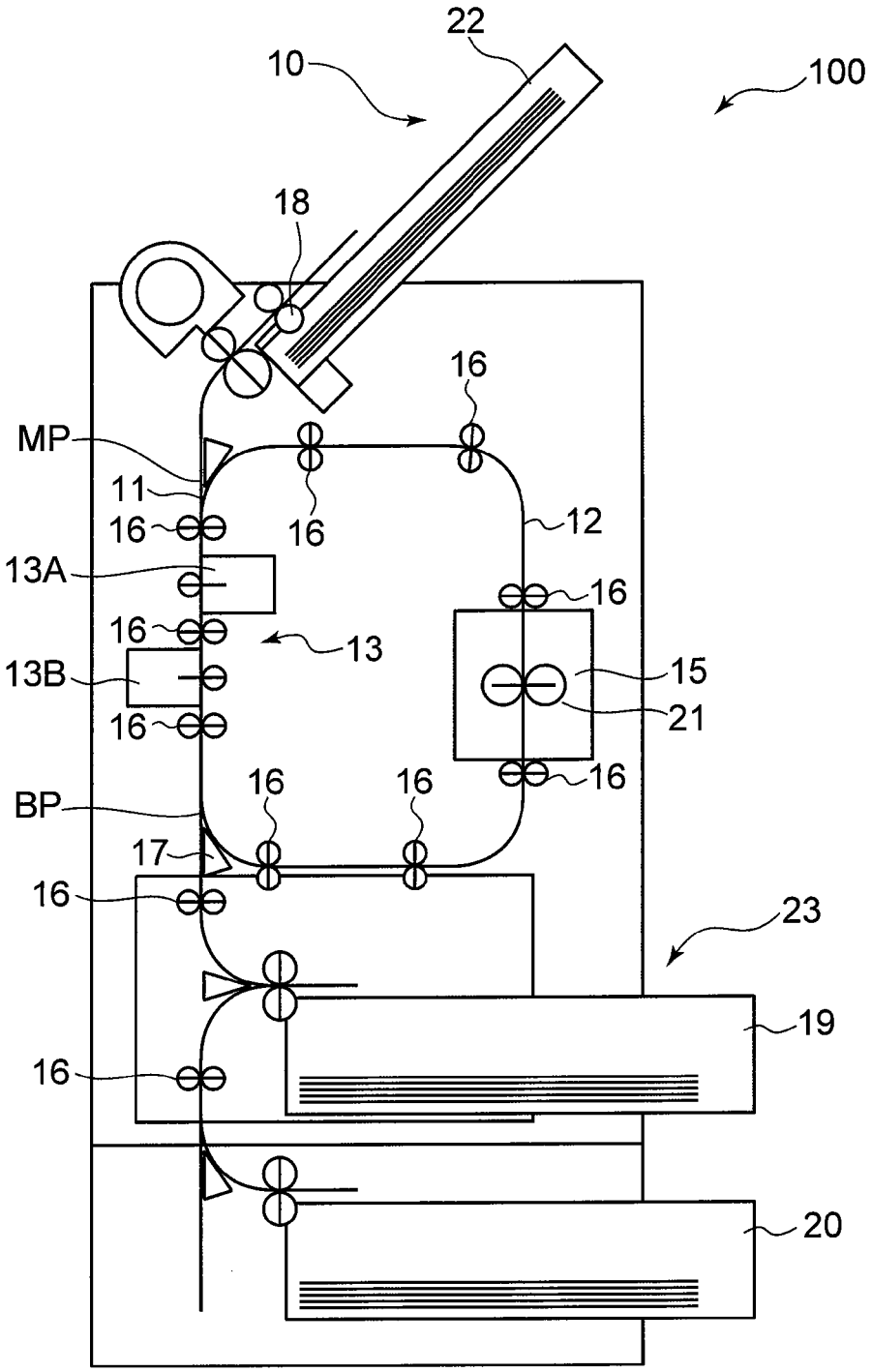
FIG. 2 is a schematic configuration diagram of an image erasing apparatus in the first embodiment.

FIG. 2 is a configuration diagram of the image erasing apparatus. In the image erasing apparatus 100, for a sheet (recording medium) on which an image forming portion forms an image with "image erasable material", such as color erasable toner and color erasable ink, an erasure performs "image erasing processing" to erase the image formed with the image erasable material (hereinafter, referred to simply as recording material). The image erasing apparatus 100 has a sheet supply portion 10, a first conveying path 11, a second conveying path 12, a reader 13, an erasure 15, conveying rollers 16, a path changer 17, a first ejector 19 and a second ejector 20.

The sheet supply portion 10 supplies a sheet P to the inside of the image erasing apparatus 100 so as to erase the color of the image of the sheet P to be reused. The sheet supply portion 10 has a sheet tray 22 and a pickup roller 18. The sheet tray 22 loads the sheet P to be reused. The pickup roller 18 picks up the sheet P one by one from the sheet tray 22 and sends out the sheet P to the first conveying path 11.

The first conveying path 11 and the second conveying path 12 have respectively a plurality of conveying rollers 16. A pair of a drive roller and a driven roller composes the conveying roller 16. The first conveying path 11 has the reader 13. In the present embodiment, the reader 13 has a first reader unit 13A and a second reader unit 13B. Each of the first reader unit 13A and the second reader unit 13B has a two-dimensional CCD scanner. The first reader unit 13A reads out one surface of the sheet conveyed from the sheet supply portion 10. The second reader unit 13B reads out the surface opposite to the surface which is read out by the first reader unit 13A. A RAM (Random Access Memory) 203 (FIG. 3), serving as a memory portion, stores the images which have been read out by the first reader unit 13A and the second reader unit 13B. The storing destination of the images which have been read out by the first reader unit 13A and the second reader unit 13B is not limited to the RAM 203, but may be a ROM (Read Only Memory) 202, a HDD (Hard Disk Drive), or a memory or the like.

Figure 3:
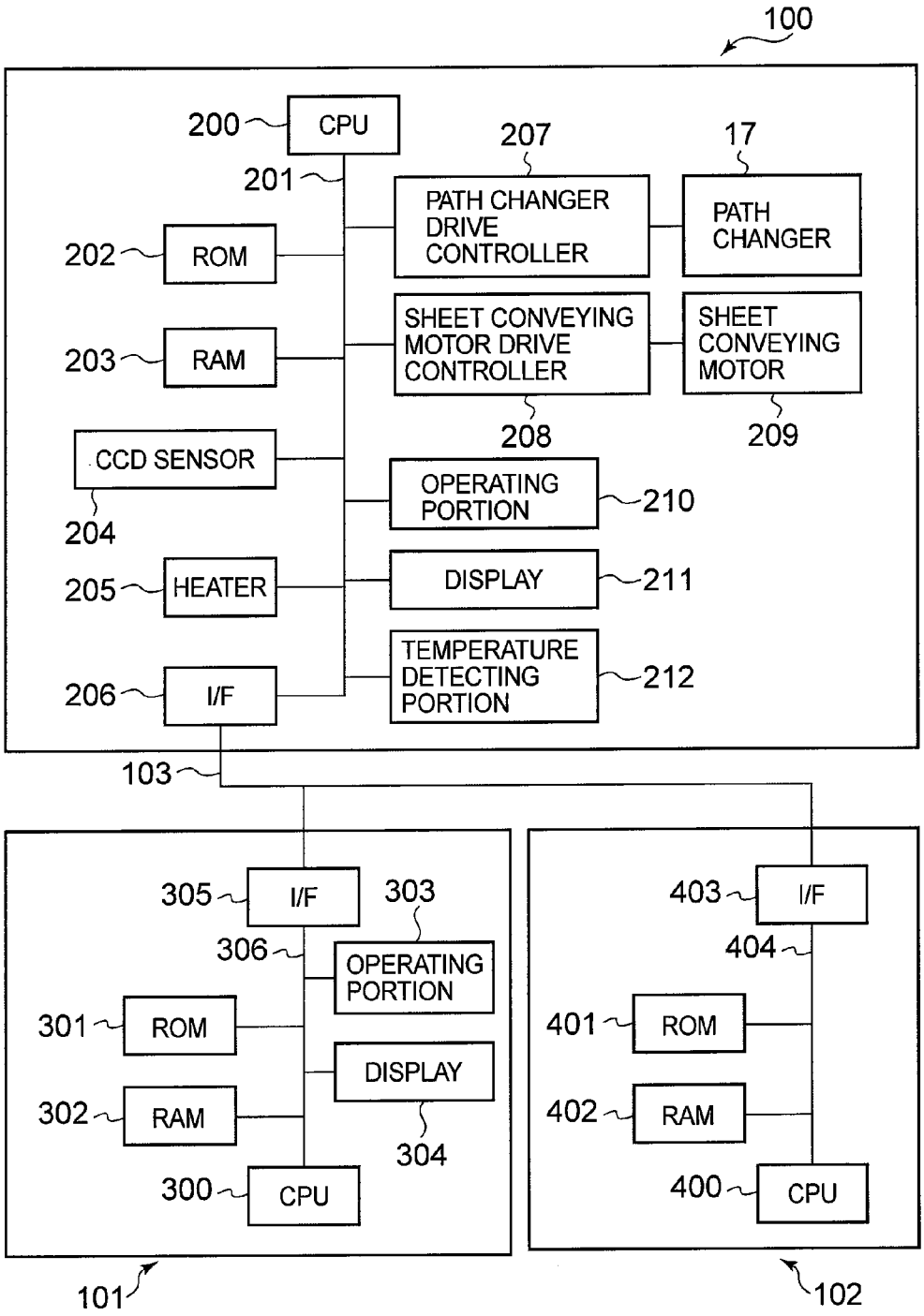
FIG. 3 is a block diagram of the image erasing apparatus, a client PC and a server in the first embodiment.

The images which have been read out by the first reader unit 13A and the second reader unit 13B are stored not exclusively in the RAM 203 of the image erasing apparatus 100 as shown in FIG. 3, but may be stored in a RAM 302 of the client PC 101 or a RAM 402 of the server 102. In addition, if the image erasing apparatus 100 has login and logout function so as to personally authenticate a user, the image data stored in the RAM 203 of the image erasing apparatus 100 may be transmitted to the RAM 302 of the client PC 101 or the RAM 402 of the server 102, and may be stored in the RAM 302 or the RAM 402 at the time of logging out from the image erasing apparatus 100. In addition, in case that the image erasing apparatus 100 has a personal authentication function, the images which have been read out by the first reader unit 13A and the second reader unit 13B may be stored in the memory or the server in association with the user ID.

In addition, the reader 13 reads out the respective surfaces of the sheet P so as to judge whether or not the sheet P is reusable or whether or not the print of the sheet has been image erased. A controller 200 which will be described later judges whether or not the sheet is image erasable or whether not or the sheet is reusable based on the images which the reader 13 has read out.

The first reader unit 13A and the second reader unit 13B read out the sheet two times, respectively. The controller 200 computerizes the images which have been read by the reader 13 at the first reading and stores the image data in the memory portion. The controller 200 judges whether or not the sheet P is reusable by the second reading by the reader 13 after image erasing.

The image erasing apparatus 100 may store the image by the first reading to judge whether or not the sheet is non-usable due to wrinkle, staple, a memo note which is not image erasable, or the like. If the image erasing apparatus 100 judges that the sheet is in the reusable state by the first reading, for example, performs the erasing processing for the sheet, and judges whether or not the image of the sheet P has been image erased by the second reading. The image erasing apparatus 100 ejects the sheet to the first ejector 19 or the second ejector 20 based on the judging result by the second reading. If the image erasing apparatus 100 judges that the sheet is in the non-reusable state by the first reading, performs the erasing processing, and without performing the second reading, ejects the sheet to the first ejector 19 or the second ejector 20. In addition, if the image erasing apparatus 100 judges that the sheet is in the non-reusable state by the first reading, may eject the sheet to the first ejector 19 or the second ejector 20, without performing the erasing processing and the second reading. These settings can be selected previously and can be set. The first reader unit 13A and the second reader unit 13B are not limited to a pair of two-dimensional CCD scanners, but may be CMOS sensors.

In addition, whether or not the sheet is non-usable due to wrinkle, staple, broken sheet, a memo note which is not image erasable, or the like may be judged based on the image read by the reading after image erasing. If the reading is performed after image erasing, wrinkle, staple, broken sheet, a memo note which is not image erasable, or the like can be easily detected. The CPU 200 judges whether or not the sheet is non-usable due to wrinkle, staple, broken sheet, a memo note which is not image erasable, or the like by the reading after image erasing, and ejects the sheet to the first ejector 19 or the second ejector 20 based on the judging result. These settings can previously be selected and set.

The first conveying path 11 forms a conveying path from the sheet supply portion 10 toward the first ejector 19 or the second ejector 20. The first conveying path 11 conveys the supplied sheet to the reader 13 or the ejector 23. The second conveying path 12 branches from the first conveying path 12 at a branching point BP (Branching Point) at the downstream side of the first reader unit 13A and the second reader unit 13B of the first conveying path 11 in the sheet conveying direction. The path changer 17 (switching portion) is arranged at the branching point BP. The path changer 17 switches the conveying direction of the sheet to be conveyed. The path changer 17 conveys the sheet which has been conveyed on the first conveying path 11 to the second conveying path 12 or the ejector 23.

The second conveying path 12 has the erasure 15 in the conveying path. The conveying rollers 16 of the second conveying path 12 which branches at the branching point convey the sheet P to the erasure 15. In addition, the second conveying path 12 merges with the first conveying path 11 at a meeting point MP (Meeting Point) at the upstream side from the reader 13 in the conveying direction. That is, the second conveying path 12 merges with the first conveying path 11 at the meeting point MP which is located between the sheet supply portion 10 and the reader 13. The erasure 15 has a roller pair 21 and a heater 205 (FIG. 3). The heater 205 heats the roller pair 21. The heater applies temperature or heat of not less than a definite temperature to the sheet P through the roller pair 21 which has been heated by the heater 205, to heat the image of the sheet P which has been formed using image erasable image forming material, and to thereby achromatize the color material.

The ejector 23 has the first ejector 19 and the second ejector 20. The sheet P to which various processings composed of the reading processing and the image erasing processing have been performed is ejected to the first ejector 19 or the second ejector 20. A user may select such that the sheet P can be ejected to any one of the first ejector 19 or the second ejector 20.

FIG. 3 is a block diagram of the image erasing apparatus 100, the client PC 101 and the server 102. The CPU (Central Processing Unit) 200 serving as a controller (controller) of the image erasing apparatus 100 is connected, through a system bus 201, to the ROM 202, the RAM 203, CCD sensors 204 of the first reader unit 13A and the second reader unit 13B, the heater 205 of the erasure 15, an interface (I/F) 206 to input data from the outside and to output data to the outside. The CPU 200 communicates with the client PC 101 and the server 102 by the I/F 206 connected through the system bus 201.

In addition, the CPU 200 is connected to a path changer drive controller 207 to control the path changer 17, a sheet conveying motor drive controller 208 to control a sheet conveying motor 209 for driving the conveying rollers, an operating portion 210, and a display 211.

A program to make the CPU 200 to be operated, a print ratio of the sheet so as to make the guideline of reusability, a density threshold value so as to judge whether or not the image has been erased are stored in the ROM 202. In addition, in case that the depth of the wrinkle is determined at the first image reading, a density threshold value which is utilized for determining the depth of the wrinkle and so on is stored in the ROM 202. The image obtained when the image of the sheet P is read is stored in the RAM 203. The CCD sensor 204 is arranged as an in-line line sensor and detects the contrasting density of the sheet P. Using an IH heater and so on, the heater 205 applies heat to the sheet P through the roller pair 21 while the sheet P passes through the erasure 15, to thereby achromatize the color material.

The operating portion 210 has the display 211 of a touch panel type and various keys, and is arranged at the upper portion of the main body of the image erasing apparatus, for example. The operation keys have a numerical keypad, a stop key, a start key and so on, for example. The display 211 displays setting information including various processing modes of the image erasing apparatus 100, an operation status, log information or a message for a user. A user can instructs to start image erasing or read the image of the sheet P via the operating portion 210. Further, the operation portion 210 of the image erasing apparatus 100 can be select the processing mode. The processing modes will be described later. The display 211 may be of a touch panel type, or may additionally operate as the operating portion. In addition, the operating portion 210 is not limited to one which is arranged in the main body of the image erasing apparatus 100. The operating portion 210 may be a configuration which can be operated from an operating unit of an external device to be connected to the image erasing apparatus 100 via a network, for example. Or the operating portion 210 may be of a type independent from the main body of the image erasing apparatus and a configuration to operate the image erasing apparatus 100 via wire or wireless communication. The operating portion of the present embodiment may be used if it can indicate the processing and browse the information to and from the image erasing apparatus 100. In the following, description will be made assuming that a touch panel is used as the display 211.

The CPU 200 controls the path changer drive controller 207 to thereby cause the path changer 17 to be driven. Thereby, the CPU 200 sorts such that the sheet P is conveyed from the first conveying path 11 to the second conveying path 12, or sorts such that the sheet P is conveyed from the first conveying path 11 to the first ejector 19 or the second ejector 20. In addition, the CPU 200 discriminates whether or not the image erasing has normally been performed after image erasing the image, that is whether or not the sheet P is reusable.

The client PC 101 has a CPU 300, a ROM 301, the RAM 302, an operating portion 303, a display 304, and an I/F 305. The CPU 300, serving as a controller of the client PC 101, is connected to the ROM 301, the RAM 302, the operating portion 303, the display 304, and the I/F 305 through a system bus 306. In addition, the images which have been read out by the first reader unit 13A and the second reader unit 13B of the image erasing apparatus 100 may be stored in the RAM 302 of the client PC 101.

The server 102 has a CPU 400, a ROM 401, the RAM 402, and an I/F 403. The CPU 400, serving as a controller of the server 102, is connected to the ROM 401, the RAM 402, the I/F 403 through a system bus 404. In addition, the images which have been read out by the first reader unit 13A and the second reader unit 13B of the image erasing apparatus 100 may be stored in the RAM 402 of the server 102.

Figure 4:
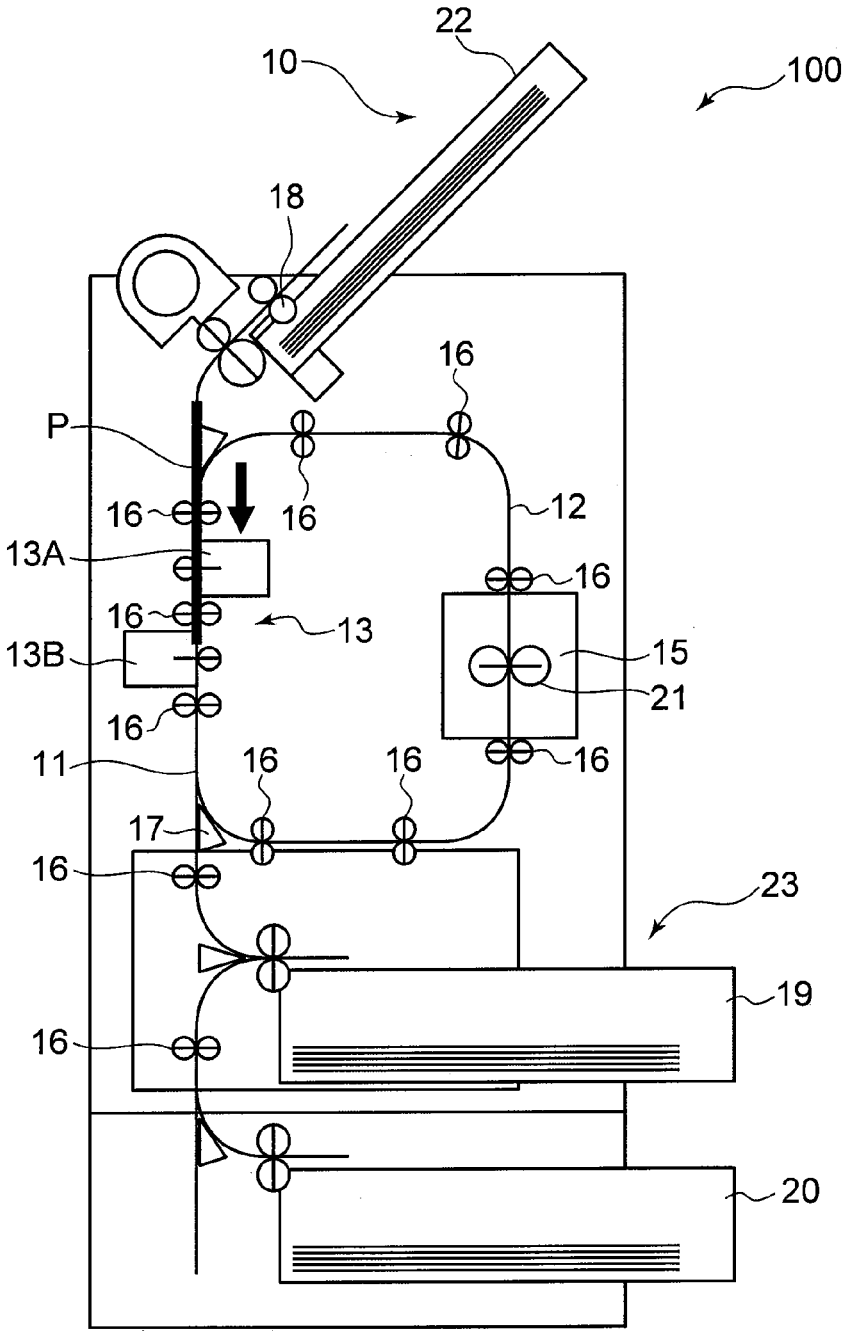
FIG. 4 is a schematic diagram showing a conveying condition of a sheet in a first conveying path of the image erasing apparatus in the first embodiment.
Figure 5:
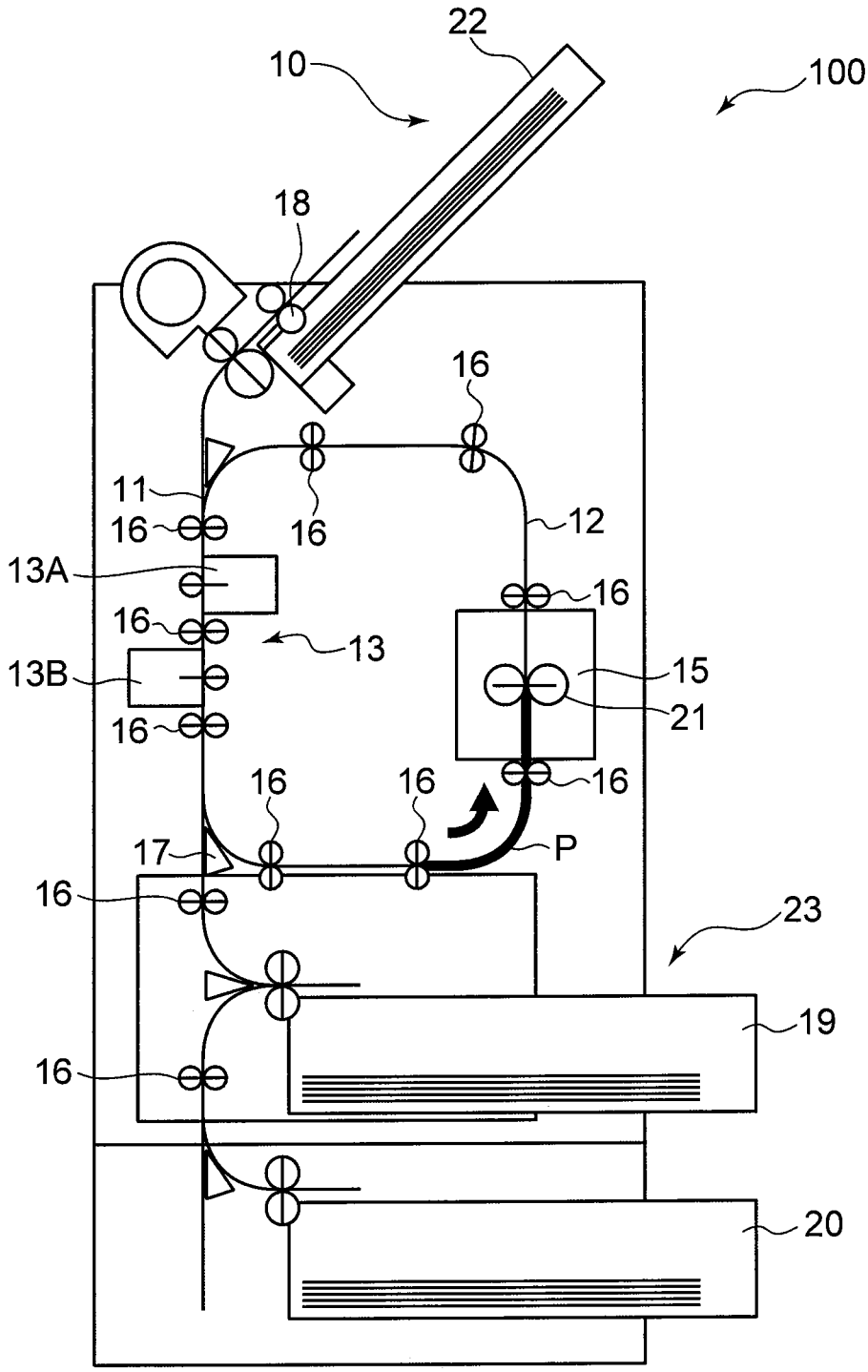
FIG. 5 is a schematic diagram showing a conveying condition of the sheet in a second conveying path of the image erasing apparatus in the first embodiment.
Figure 6:
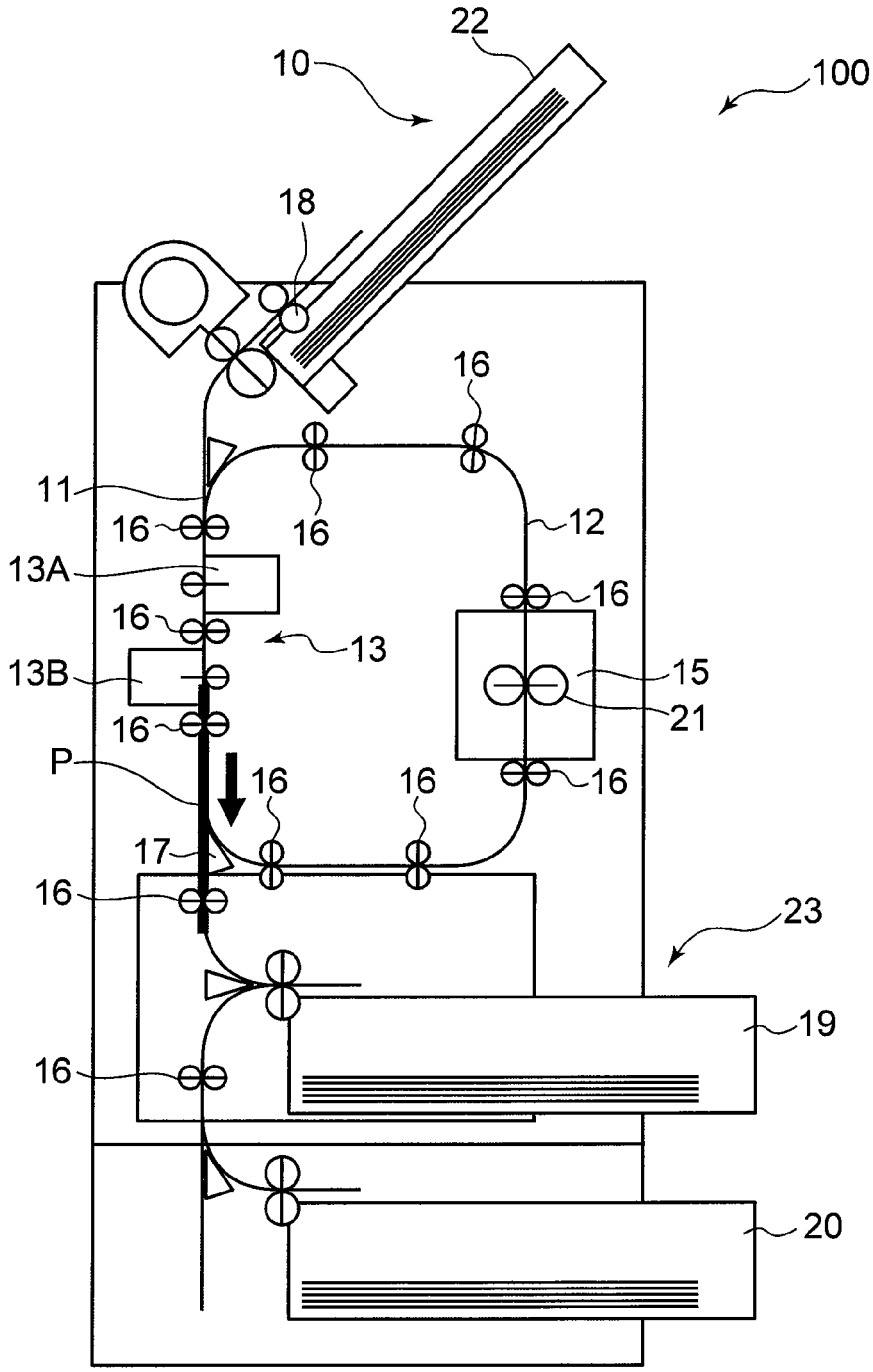
FIG. 6 is a schematic diagram showing a conveying condition of the sheet, after image erasing processing, in the first conveying path of the image erasing apparatus in the first embodiment.

FIG. 4 to FIG. 6 are views each showing a conveying condition of the sheet P in the first conveying path 11 and the second conveying path 12 of the image erasing apparatus 100.

FIG. 4 shows the condition where the first conveying path 11 conveys the sheet P which the pickup roller 18 has taken out and supplied from the sheet supply portion 10. An arrow in the drawing shows a traveling direction of the sheet P. The conveying rollers 16 convey the sheet P to the first conveying path 11, and the first reader unit 13A and the second reader unit 13B read out the images on the sheet P, respectively. When the first reader unit 13A or the second reader unit 13B detects the sheet P, the path changer 17 rotates in the direction to convey the sheet P from the first conveying path 11 to the second conveying path 12. The path changer 17 sorts sheet P from which the first reader unit 13A and the second reader unit 13B have read out the images into the second conveying path 12.

FIG. 5 shows the condition where the conveying rollers 16 of the second conveying path 12 convey the sheet P. The erasure 15 erases the color of the images on the sheet P which the conveying rollers 16 have conveyed from the first conveying path 11 to the second conveying path 12 through the path changer 17. When the erasure 15 erases the color of the images on the sheet P, the conveying rollers 16 of the second conveying path 12 and the first conveying path 11 convey the sheet P whose images have been erased to the upstream side of the first reader unit 13A and the second reader unit 13B of the first conveying path 11.

FIG. 6 shows the conveying condition of the sheet P in the first conveying path 11 after the image erasing processing of the images. The first reader unit 13A and the second reader unit 13B read out again the respective images on the sheet P which the conveying rollers 16 of the second conveying path 12 have conveyed from the second conveying path 12 to the first conveying path 11. When the first reader unit 13A and the second reader unit 13B read out again the images, respectively, the path changer 17 rotates in the direction to convey the sheet P from the first conveying path 11 to the ejector 23.

The path changer 17 sorts the sheet P whose images have been read out again into the first ejector 19 or the second ejector 20.

The first ejector 19 is determined as a sheet ejecting destination of the reusable sheet P, and the second ejector 20 is determined as a sheet ejecting destination of the non-reusable sheet P. The CPU 200 judges whether or not the sheet P is reusable from the images which the first reader unit 13A and the second reader unit 13B have read out. The CPU 200 causes the sheet P to be conveyed to the first ejector 19, if reusable. The CPU 200 causes the sheet P to be conveyed to the second ejector 20, if not reusable. Without being limited to this, the CPU 200 may cause the sheet P to be conveyed to the second ejector 20, if reusable, and may cause the sheet P to be conveyed to the first ejector 19, if not reusable.

In case that the CPU 200 performs both the image reading and the discrimination of whether the sheet P is a reusable sheet or a non-reusable sheet after the images have been erased, the sheet P is conveyed to the first reader unit 13A and the second reader unit 13B two times. In case that the sheet P is processed one by one, the first reader unit 13A and the second reader unit 13B perform alternately the image reading so as to remain the image data before image erasing and the image reading so as to discriminate whether or not the image erasing has normally been performed after image erasing the images, respectively.

In addition, the CPU 200 varies the conveying speeds of the sheet P respectively, when the first reader unit 13A and the second reader unit 13B read the respective images and when the erasure 15 erases the color of the images. When the erasure 15 performs the image erasing processing, if the sheet P is conveyed at a conveying speed faster than a prescribed speed, the heater 205 can not apply a sufficient amount of heat to the color material, and thereby the image erasing processing might not normally be performed. On the other hand, though maximum speeds in the reader are different depending on the material, a maximum conveying speed at the time of image reading is faster than a maximum conveying speed at the image erasing processing. For this reason, at the time of image erasing processing, the relation between a conveying speed V1 at the time of image erasing and a conveying speed V2 at the time of reading is determined as $V1<V2$.

On the other hand, when the reading processing is performed without performing the image erasing processing, since it is not necessary to make the conveying speed V2 at the time of reading equal to the conveying speed V1 pass through the erasure 15 at the time of image erasing processing, the sheet P is conveyed through the erasure 15 at the speed $V1\geq V2$. The conveying speeds of the sheet P are varied at the time of reading the image and at the time of erasing the image, and thereby the processing can be speeded up.

In addition, in case that the images which have been read by the reader 13 are stored in the memory of the image erasing apparatus 100 or the server 102, the images can be accessed through the operating portion 210 of the image erasing apparatus 100, a user terminal, or an operating unit of other external device. In case that the images are stored in association with a user ID, it becomes possible to retrieve the images using the user ID to thereby extract the associated image. The retrieved images can be stored in the moving destination assigned by the user, or can be used for browsing and so on.

In the image erasing apparatus 100 as described above, the reader to read the image so as to remain the image data in the data memory portion, and the reader to read the image so as to discriminate whether or not the image erasing has normally been performed are made a common reader, and thereby the cost can be reduced. In addition, the conveying speeds of the sheet P at the time of reading the image and at the time of erasing the image are made different, and thereby the processing can be speeded up.

(Second Embodiment) An image erasing apparatus of a second embodiment shown in FIG. 10 to FIG. 15 has a plurality of processing modes. In the drawings, the same symbols are given to the same constituent components as in the first embodiment.

A first one is a image erasing mode, a second one is a reading mode, and a third one is a discriminating mode. A fourth one is a mode which is combined with the reading and the image erasing, a fifth one is a mode which is combined with the image erasing and the discrimination, and a sixth one is a mode which is combined with the reading, the image erasing and the discrimination.

An image erasing apparatus 100 of the present embodiment comprises a sheet supply portion 10 to supply a sheet, an ejector (a first ejector 19 and a second ejector 20) to which a recording medium is ejected, a first conveying path 11 to form a conveying path from the sheet supply portion 10 toward the ejector, a reader 13 arranged on the first conveying path 11 to read an image on a surface of the sheet, a erasure 15 to erase the image on the sheet formed with image erasable material, a switching portion (a path changer) 17 arranged on the first conveying path 11 at a downstream side of the reader 13 in a sheet conveying direction to switch the sheet conveying direction to a direction of the ejector or a direction of the erasure 15, a second conveying path 12 having the erasure 15 which, at a position where the switching portion 17 is arranged, branches from the first conveying path 11 at the downstream side of the reader 13 and merges with the first conveying path 11 at a meeting point between the sheet supply portion 10 and the reader 13, and a controller (a CPU) 200 to control so as to change the sheet conveying direction by the switching portion 17 depending on a processing mode.

Figure 7:
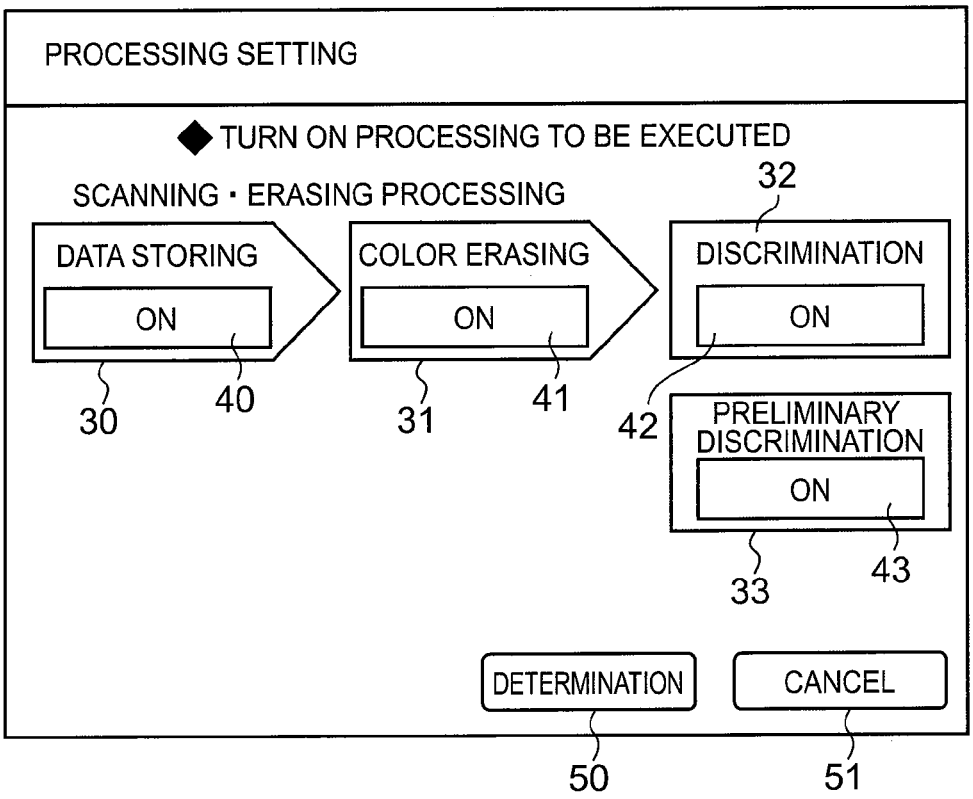
FIG. 7 is a first display example showing mode selection by setting items on the display.

FIG. 7 is a first display example showing mode selection by setting items on the display 211. At the time of processing setting, the CPU 200 displays setting items 31, 32, 33, 33, processing selection buttons 40, 41, 42, 43, a determination button 50, a cancel button 51 on the display. In addition, at the time of the processing setting, the CPU 200 displays "TURN ON PROCESSING TO BE EXECUTED", for example, to thereby urge the processing selection. The CPU 200 displays the setting items 30, 31, 32 in a line in the sequence to be processed. In FIG. 7, the setting items 30, 31, 32 are displayed in a line in the sequence from the left. The setting item 30 is data storing, the setting item 31 is image erasing, the setting item 32 is discrimination, and the setting item 33 is preliminary discrimination. The sequence of arranging the setting items 30, 31, 32 is not limited to from the left, but may be displayed in a line in the sequence from above, for example. The CPU 200 accepts at least one processing mode out of the reading mode to read the image in the reader 13, the image erasing mode to erase the image in the erasure 15, and the discriminating mode to judge whether or not the sheet is reusable in the reader 13, and performs the accepted processing. If the CPU 200 accepts the mode which is combined with the reading, the image erasing and the discrimination, for example, performs the reading, the image erasing processing and the discriminating processing. In addition, in case that the size of the sheet P is larger than a prescribed size, even if the CPU 200 accepts the mode not to perform the image erasing processing, switches the path changer 17 so as to make the sheet P to be conveyed to the second conveying path 12 having the erasure 15. In this time, the CPU 200 conveys the sheet P without performing the image erasing processing. The mode not to perform the image erasing processing indicates the reading mode or the discriminating mode.

The preliminary discrimination is processing to confirm a print ratio by the first reading to thereby perform discrimination. If the print ratio is high, the CPU 200 does not perform the image erasing processing, judges that the sheet is not reusable, and ejects the sheet to the second ejector 20. If a print ratio in the detection range is not less than the threshold value, judges that the print ratio is high. The threshold value of the print ratio to judge whether or not the sheet is reusable may be changed arbitrarily.

The setting items 30, 31, 32 are each displayed by a shape indicating a sequence to be processed. The shapes of the setting items 30, 31 are shown by arrows, respectively, so that the sequence to be processed can be found. In addition, the sequence to be processed is not only displayed by an arrow, but may be described by an alphanumeric character or a character.

The CPU 200 displays the setting item 30 and the processing selection button 40, the setting item 31 and the processing selection button 41, the setting item 32 and the processing selection button 42, and the setting item 33 and the processing selection button 43, in pairs, respectively. ON or OFF can be selected on the processing selection buttons 40, 41, 42, 43 respectively. If ON is selected on the processing selection button 40, a setting to perform data storing processing is made, if ON is selected on the processing selection button 41, a setting to perform the image erasing processing is made, if ON is selected on the processing selection button 42, a setting to perform the discriminating processing is made, and if ON is selected on the processing selection button 43, a setting to perform the preliminarily discriminating processing is made. If OFF is selected on the processing selection button 40, a setting not to perform the data storing processing is made, if OFF is selected on the processing selection button 41, a setting not to perform the image erasing processing is made, if OFF is selected on the processing selection button 42, a setting not to perform the discriminating processing is made, and if OFF is selected on the processing selection button 43, a setting not to perform the preliminarily discriminating processing is made. The display 211 is made of a touch panel, and if the CPU 200 judges that the processing selection buttons 40, 41, 42, 43 have been pushed down, displays selective tabs and thereby displays ON or OFF on them in a selectable manner, respectively.

A user selects ON or OFF on the selection buttons 40, 41, 42, 43, and after finishing the selections, pushes down the determination button 50. If the CPU 200 judges that the determination button 50 has been pushed down, determines a mode. In addition, if the CPU 200 judges that the cancel button 51 has been pushed down, stops processing setting.

FIG. 8 is a table showing the relation between a setting item and a mode. The modes are selected by the setting of the processing setting buttons 40, 41, 42 of the setting items 30, 31, 32. By the combination of ON or OFF of the processing setting buttons 40, 41, 42, the six modes of the image erasing mode, the reading mode, the discriminating mode, the mode which is combined with the reading and the image erasing, the mode which is combined with the image erasing and the discrimination, and the mode which is combined with the reading, the image erasing and the discrimination.

If ON is selected on the processing setting button 40 of the setting item 30 of the data storing, OFF is selected on the processing setting button 43 of the setting item 33 of the preliminary discrimination, OFF is selected on the processing setting button 41 of the setting item 31 of the image erasing, and OFF is selected on the processing setting button 42 of the setting item 32 of the discrimination, the CPU 200 judges this to be the reading mode. If OFF is selected on the processing setting button 40 of the setting item 30 of the data storing, ON is selected on the processing setting button 43 of the setting item 33 of the preliminary discrimination, OFF is selected on the processing setting button 41 of the setting item 31 of the image erasing, and OFF is selected on the processing setting button 42 of the setting item 32 of the discrimination, the CPU 200 judges this to be the preliminarily discriminating mode. If OFF is selected on the processing setting button 40 of the setting item 30 of the data storing, OFF is selected on the processing setting button 43 of the setting item 33 of the preliminary discrimination, ON is selected on the processing setting button 41 of the setting item 31 of the image erasing, and OFF is selected on the processing setting button 42 of the setting item 32 of the discrimination, the CPU 200 judges this to be the image erasing mode. If OFF is selected on the processing setting button 40 of the setting item 30 of the data storing, OFF is selected on the processing setting button 43 of the setting item 33 of the preliminary discrimination, OFF is selected on the processing setting button 41 of the setting item 31 of the image erasing, and ON is selected on the processing setting button 42 of the setting item 32 of the discrimination, the CPU 200 judges this to be the discriminating mode.

If ON is selected on the processing setting button 40 of the setting item 30 of the data storing, OFF is selected on the processing setting button 43 of the setting item 33 of the preliminary discrimination, ON is selected on the processing setting button 41 of the setting item 31 of the image erasing, and OFF is selected on the processing setting button 42 of the setting item 32 of the discrimination, the CPU 200 judges this to be the mode which is combined with the reading and the image erasing. If OFF is selected on the processing setting button 40 of the setting item 30 of the data storing, OFF is selected on the processing setting button 43 of the setting item 33 of the preliminary discrimination, ON is selected on the processing setting button 41 of the setting item 31 of the image erasing, and ON is selected on the processing setting button 42 of the setting item 32 of the discrimination, the CPU 200 judges this to be the mode which is combined with the image erasing and the discrimination. If ON is selected on the processing setting button 40 of the setting item 30 of the data storing, OFF is selected on the processing setting button 43 of the setting item 33 of the preliminary discrimination, ON is selected on the processing setting button 41 of the setting item 31 of the image erasing, and ON is selected on the processing setting button 42 of the setting item 32 of the discrimination, the CPU 200 judges this to be the mode which is combined with the reading, the image erasing and the discrimination. If ON is selected on the processing setting button 40 of the setting item 30 of the data storing, ON is selected on the processing setting button 43 of the setting item 33 of the preliminary discrimination, OFF is selected on the processing setting button 41 of the setting item 31 of the image erasing, and OFF is selected on the processing setting button 42 of the setting item 32 of the discrimination, the CPU 200 judges this to be the mode which is combined with the reading and the preliminary discrimination.

If OFF is selected on the processing setting button 40 of the setting item 30 of the data storing, ON is selected on the processing setting button 43 of the setting item 33 of the preliminary discrimination, ON is selected on the processing setting button 41 of the setting item 31 of the image erasing, and OFF is selected on the processing setting button 42 of the setting item 32 of the discrimination, the CPU 200 judges this to be the mode which is combined with the preliminary discrimination and the image erasing. If ON is selected on the processing setting button 40 of the setting item 30 of the data storing, ON is selected on the processing setting button 43 of the setting item 33 of the preliminary discrimination, ON is selected on the processing setting button 41 of the setting item 31 of the image erasing, and OFF is selected on the processing setting button 42 of the setting item 32 of the discrimination, the CPU 200 judges this to be the mode which is combined with the reading, the preliminary discrimination and the image erasing. If OFF is selected on the processing setting button 40 of the setting item 30 of the data storing, ON is selected on the processing setting button 43 of the setting item 33 of the preliminary discrimination, ON is selected on the processing setting button 41 of the setting item 31 of the image erasing, and ON is selected on the processing setting button 42 of the setting item 32 of the discrimination, the CPU 200 judges this to be the mode which is combined with the preliminary discrimination, the image erasing and the discrimination. If ON is selected on the processing setting button 40 of the setting item 30 of the data storing, ON is selected on the processing setting button 43 of the setting item 33 of the preliminary discrimination, ON is selected on the processing setting button 41 of the setting item 31 of the image erasing, and ON is selected on the processing setting button 42 of the setting item 32 of the discrimination, the CPU 200 judges this to be the mode which is combined with the reading, the preliminary discrimination, the image erasing and the discrimination.

In the above description, ON or OFF is selected on each of the processing setting buttons 40, 41, 42, 43 to thereby perform setting, but without being limited this, ON or OFF may be displayed as "PROCESSED" or "NOT PROCESSED".

Figure 9:
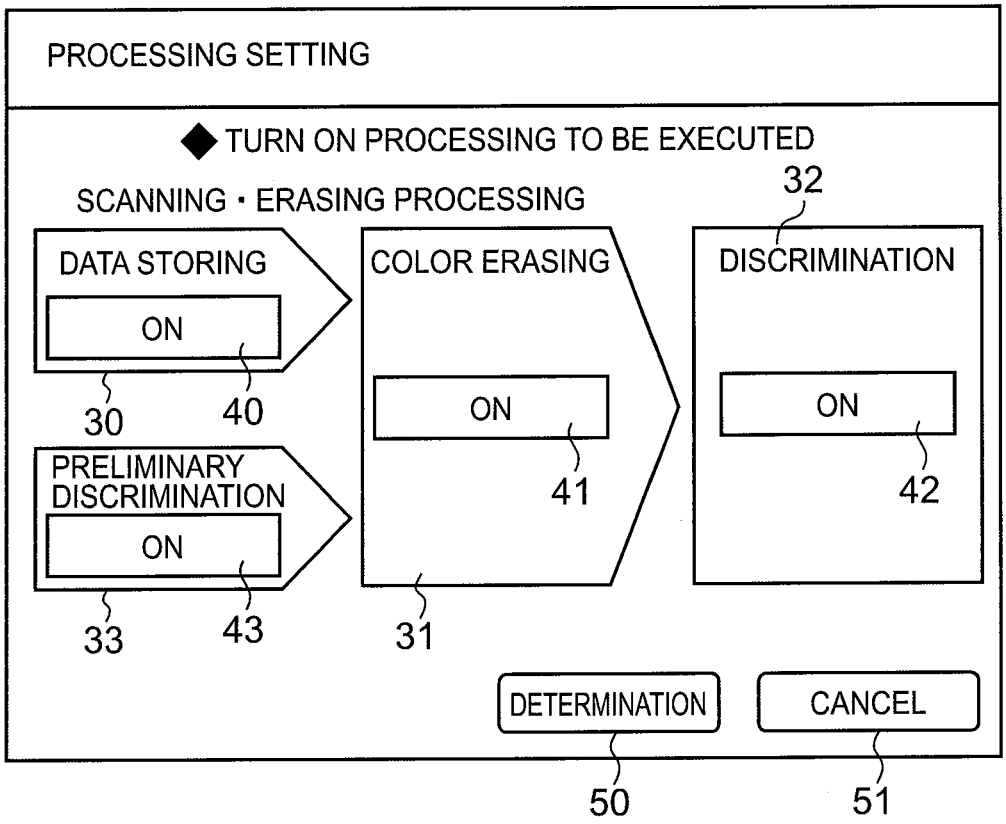
FIG. 9 is a second display example showing mode selection by setting items on the display.

In FIG. 7, the setting items 30 (data storing), 31 (image erasing), 32 (discrimination) are displayed in a line in the sequence to be processed from the left, and the setting item 33 (preliminary discrimination) is displayed differently, but as shown in FIG. 9, the four setting items including the setting item 33 of the preliminary discrimination may be displayed in a line in the sequence to be processed. Since the data storing and the preliminary discrimination are performed at the first reading time, the setting items 30, 33 of the data storing and the preliminary discrimination are displayed up and down in a line as the items to be processed in parallel in FIG. 9. The setting items are displayed in a line in the sequence to be processed like this, and thereby a display which a user can easily understand is obtained.

Figure 10:
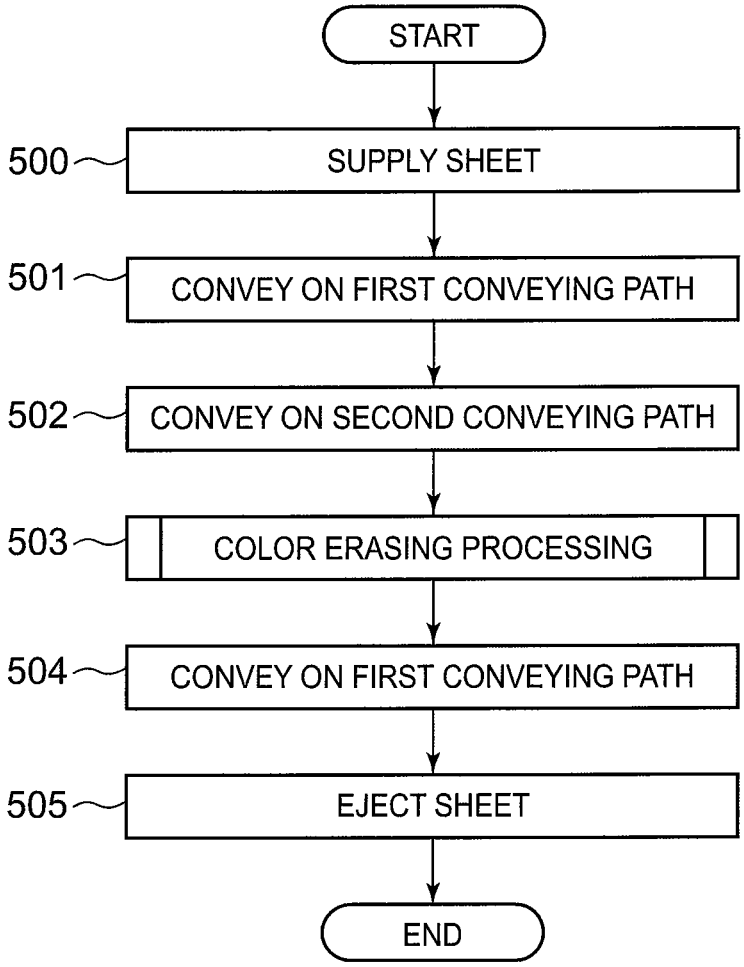
FIG. 10 is a flow chart showing image erasing processing in a second embodiment.

The image erasing mode will be described. The image erasing mode does not perform the image reading, but performs the image erasing processing. FIG. 10 is a flow chart of the image erasing mode. If the image erasing mode is selected by the respective processing selection buttons 40, 41, 42, 43 of the setting items 30, 31, 32, 33 of FIG. 7, in 500, the pickup roller 18 supplies the sheet P from the sheet tray 22, and in 501, conveys the sheet P to the first conveying path 11. In 502, the path changer drive controller 207 drives the path changer 17, and the conveying rollers 16 convey the sheet P from the first conveying path 11 to the second conveying path 12. In 503, the erasure 15 performs the image erasing processing of the images on the sheet P. Then, in 504, the conveying rollers 16 convey the sheet P from the second conveying path 12 to the first conveying path 11. In 505, the conveying rollers 16 eject the sheet P to the first ejector 19 or the second ejector 20, and then the CPU 200 ends the operation.

The reading mode will be described. The reading mode does not perform the image erasing, but performs the image reading processing.

Figure 11:
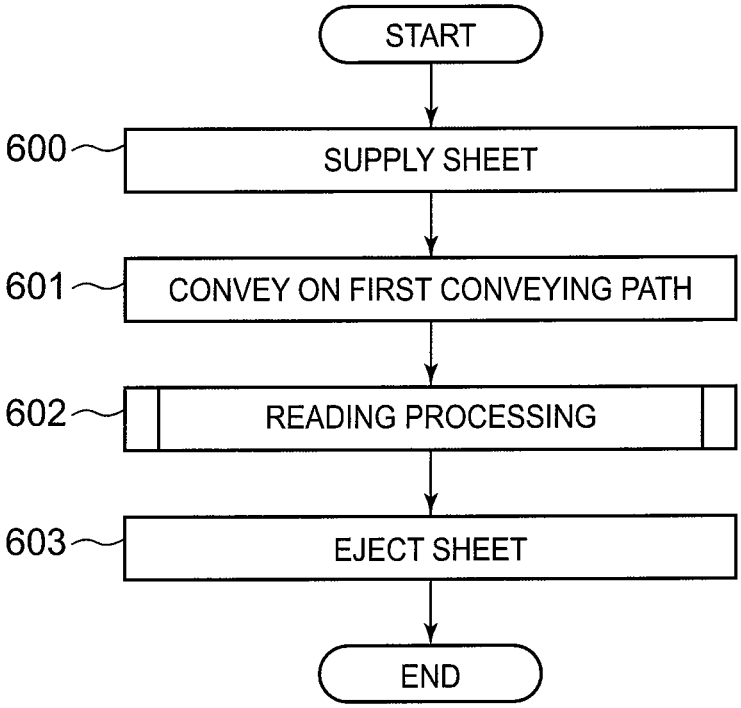
FIG. 11 is a flow chart showing reading processing in the second embodiment.

FIG. 11 is a flow chart of the reading mode. If the reading mode is selected by the respective processing selection buttons 40, 41, 42, 43 of the setting items 30, 31, 32, 33 of FIG. 7, in 600, the pickup roller 18 supplies the sheet P from the sheet tray 22, and in 601, the conveying rollers 16 convey the sheet P to the first conveying path 11. In 602, the first reader unit 13A and the second reader unit 13B read the images on the sheet P, respectively, and store the read images in the memory. In 603, the conveying rollers 16 eject the sheet P to the first ejector 19 or the second ejector 20, and then the operation ends.

The discriminating mode will be described. The discriminating mode does not perform the image erasing, but performs the discrimination of whether or not the sheet P is reusable.

Figure 12:
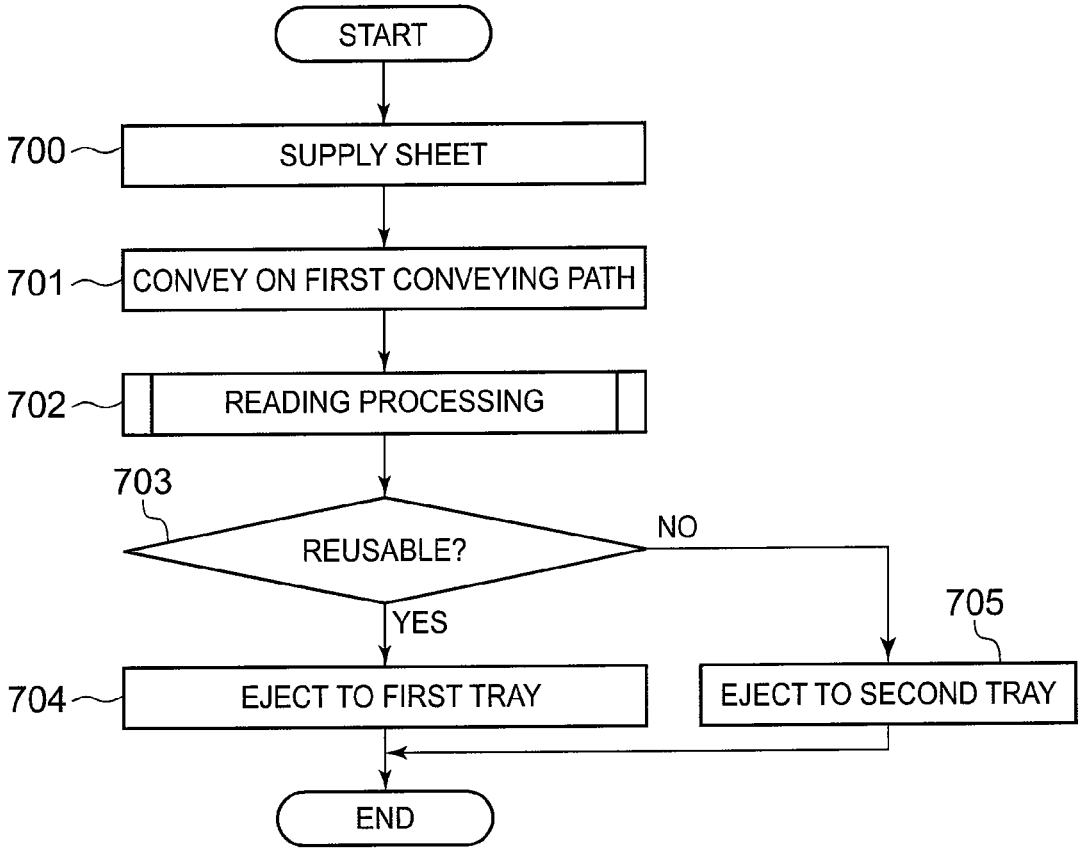
FIG. 12 is a flow chart showing discriminating processing in the second embodiment.

FIG. 12 is a flow chart of the discriminating mode. If the discriminating mode is selected by the respective processing selection buttons 40, 41, 42, 43 of the setting items 30, 31, 32, 33 of FIG. 7, in 700, the pickup roller 18 supplies the sheet P from the sheet tray 22, and in 701, the conveying rollers 16 convey the sheet P to the first conveying path 11. In 702, the first reader unit 13A and the second reader unit 13B read the images on the sheet P, respectively, and in 703, the CPU judges whether or not the sheet P is reusable. If reusable (Yes in 703), in 704, the conveying rollers 16 eject the sheet P to the first ejector 19, and then the operation ends. If not reusable (No in 703), in 705, the conveying rollers 16 eject the sheet P to the second ejector 20, and then the operation ends.

The mode which is combined with the reading and the image erasing will be described. The mode which is combined with the reading and the image erasing does not perform the discriminating processing, but after reading the image, performs the image erasing processing.

Figure 13:
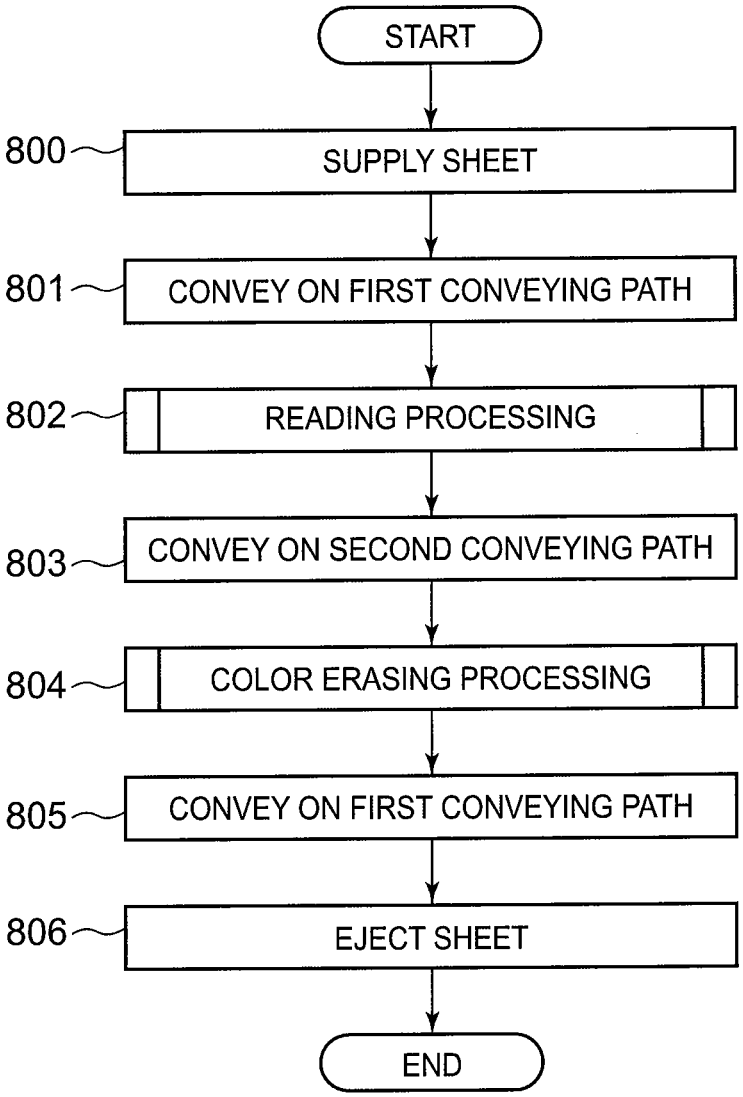
FIG. 13 is a flow chart showing reading and image erasing processing in the second embodiment.

FIG. 13 is a flow chart of the mode which is combined with the reading and the image erasing. If the mode which is combined with the reading and the image erasing is selected by the respective processing selection buttons 40, 41, 42, 43 of the setting items 30, 31, 32, 33 of FIG. 7, in 800, the pickup roller 18 supplies sheet P, and in 801, the conveying rollers 16 convey the sheet P to the first conveying path 11. In 802, the first reader unit 13A and the second reader unit 13B read the respective images on the sheet P. In 803, the path changer drive controller 207 drives the path changer 17, and thereby the conveying rollers 16 convey the sheet P from the first conveying path 11 to the second conveying path 12. In 804, the erasure 15 performs the image erasing processing of the images on the sheet P. Then, in 805, the conveying rollers 16 convey the sheet P from the second conveying path 12 to the first conveying path 11. In 806, the conveying rollers 16 eject the sheet P to the first ejector 19 or the second ejector 20, and then the operation ends.

The mode which is combined with the image erasing and the discrimination will be described. The mode which is combined with the image erasing and the discrimination does not perform the reading processing before image erasing, but after the image erasing processing, performs the discrimination of whether or not the sheet P is reusable.

Figure 14:
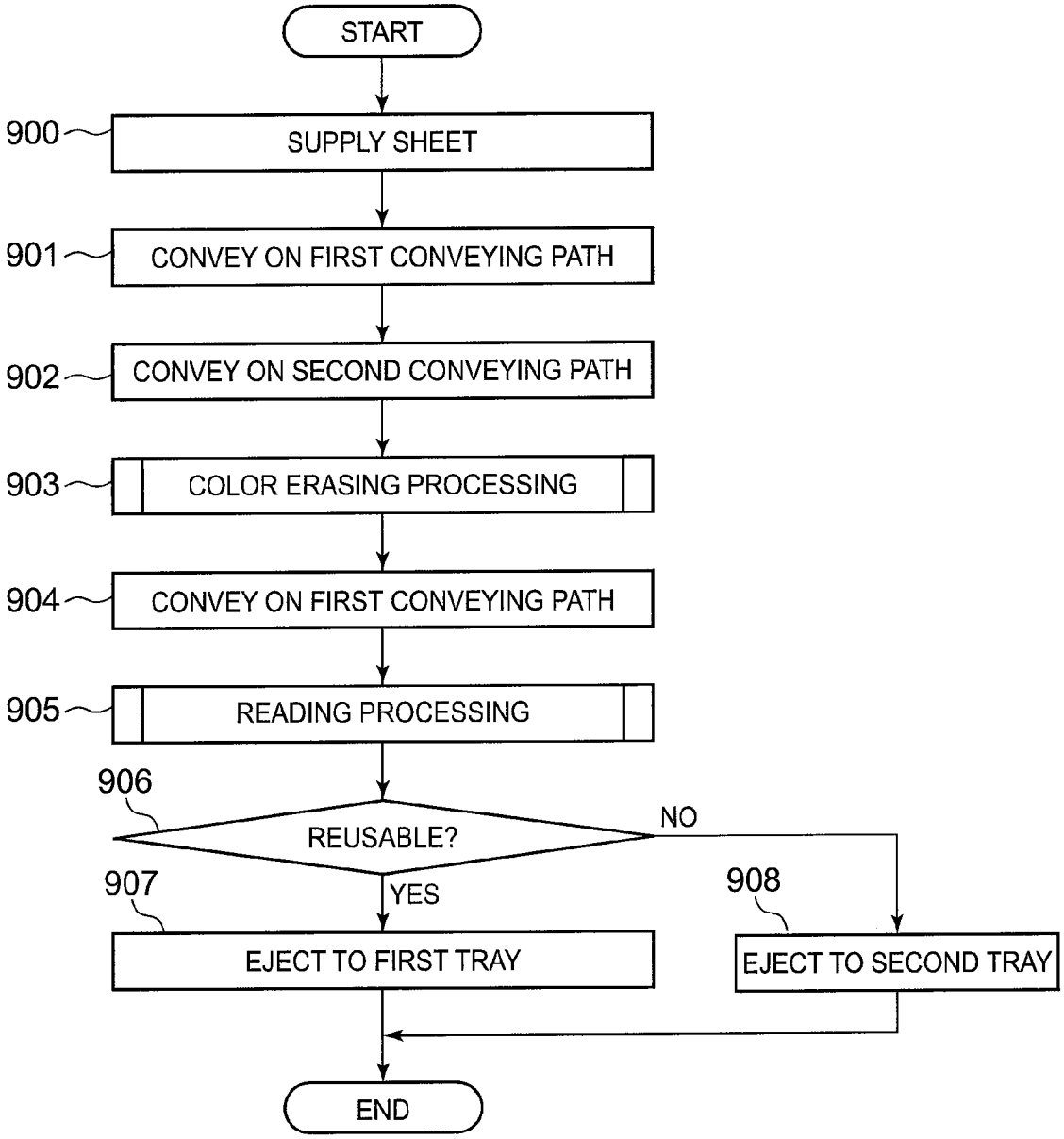
FIG. 14 is a flow chart showing image erasing and discriminating processing in the second embodiment.

FIG. 14 is a flow chart of the mode in which the image erasing and the discrimination are combined. If the mode which is combined with the image erasing and the discrimination is selected by the respective processing selection buttons 40, 41, 42, 43 of the setting items 30, 31, 32, 33 of FIG. 7, in 900, the pickup roller 18 supplies the sheet P from the sheet tray 22, and in 901, the conveying rollers 16 convey the sheet P to the first conveying path 11. In 902, the path changer drive controller 207 drives the path changer 17, and thereby the conveying rollers 16 convey the sheet P from the first conveying path 11 to the second conveying path 12. In 903, the erasure 15 performs the image erasing processing of the images on the sheet P. Then, in 904, the conveying rollers 16 convey the sheet P from the second conveying path 12 to the first conveying path 11. In 905, the first reader unit 13A and the second reader unit 13B read the respective images of the sheet P. In 906, the CPU 200 judges whether the sheet P is reusable or not. If reusable (Yes in 906), in 907, the conveying rollers 16 eject the sheet P to the first ejector 19, and then the operation ends. If not reusable (No in 906), the conveying rollers 16 eject the sheet P to the second ejector 20, and then the operation ends.

The mode which is combined with the reading, the image erasing and the discrimination will be described. The mode which is combined with the reading, the image erasing and the discrimination performs the image erasing after reading the image, and then performs the discriminating processing.

Figure 15:
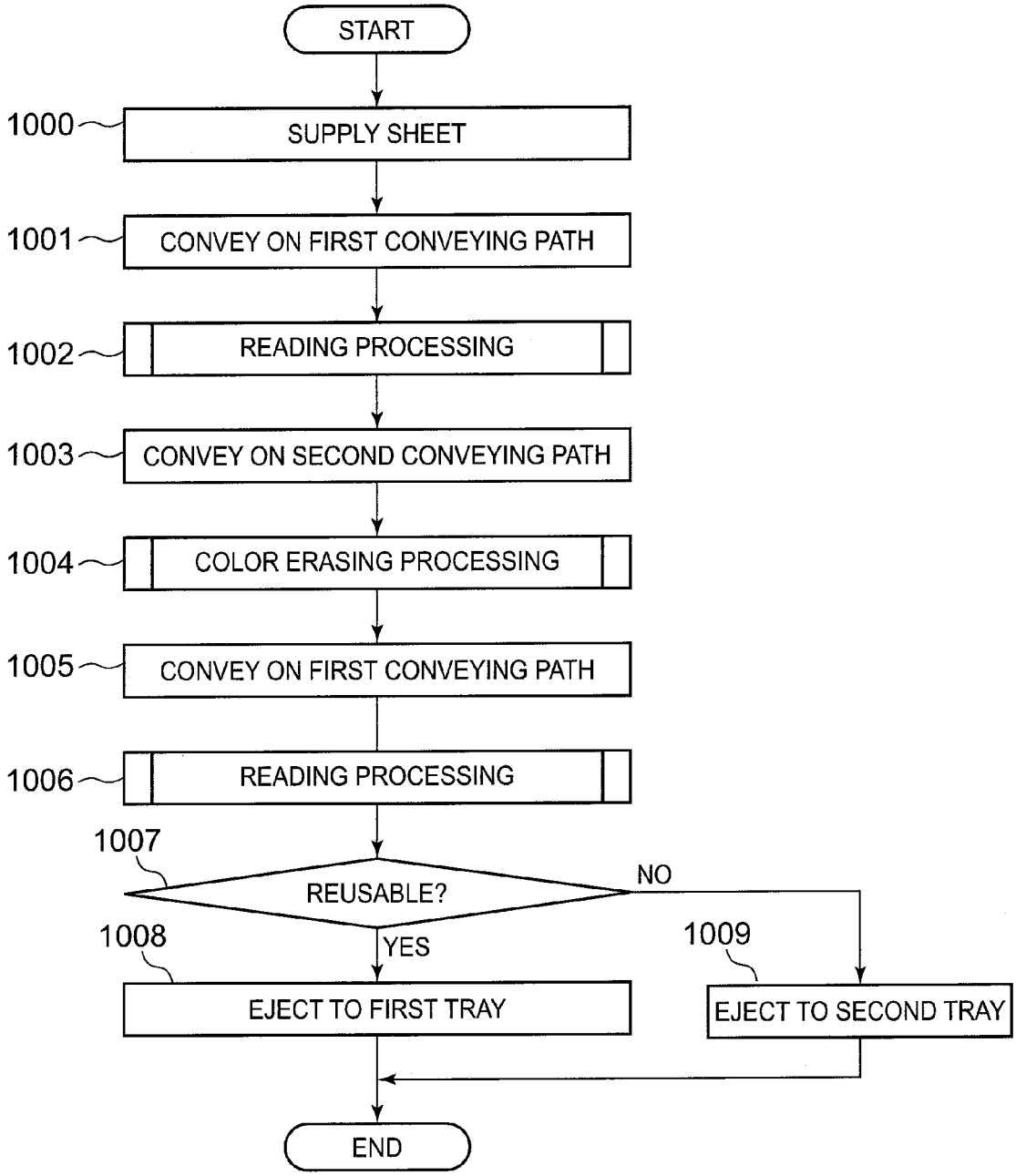
FIG. 15 is a flow chart showing reading, image erasing and discriminating processing in the second embodiment.

FIG. 15 is a flow chart of the mode which is combined with the reading, the image erasing and the discrimination. If the mode which is combined with the reading, the image erasing and the discrimination is selected by the respective processing selection buttons 40, 41, 42, 43 of the setting items 30, 31, 32, 33 of FIG. 7, in 1000, the pickup roller 18 supplies the sheet P, and in 1001, the conveying rollers 16 convey the sheet P to the first conveying path 11. In 1002, the first reader unit 13A and the second reader unit 13B read the respective images on the sheet P. In 1003, the path changer drive controller 207 drives the path changer 17, and then the conveying rollers 16 convey the sheet P from the first conveying path 11 to the second conveying path 12. In 1004, the erasure 15 performs the image erasing processing of the image on the sheet P.

Then, in 1005, the conveying rollers 16 convey the sheet P from the second conveying path 12 to the first conveying path 11. In 1006, the first reader unit 13A and the second reader unit 13B read the respective images on the sheet P. In 1007, the CPU 200 judges whether or not the sheet P is reusable. If reusable (Yes in 1007), in 1008, the conveying rollers 16 eject the sheet P to the first ejector 19, and then the operation ends. If not reusable (No in 1007), in 1009, the conveying rollers 16 eject the sheet P to the second ejector 20, and then the operation ends.

The preliminarily discriminating mode will be described. The preliminarily discriminating mode does not perform the image erasing, but performs the judgment of whether or not the sheet P is reusable depending on the print ratio.

If the CPU 200 judges that the preliminarily discriminating mode is selected by the respective processing selection buttons 40, 41, 42, 43 of the setting items 30, 31, 32, 33 of FIG. 7, the CPU 200 controls so that the pickup roller 18 supplies the sheet P from the sheet tray 22 and controls the conveying rollers 16 so as to convey the sheet P to the first conveying path 11. The CPU 200 reads the images of the sheet P by the first reader unit 13A and the second reader unit 13B and controls so as to judge the print ratio. Then, if the CPU 200 judges that the print ratio is smaller than the threshold value, controls the conveying rollers 16 so as to eject the sheet P to the first ejector 19, and if the CPU 200 judges that the print ratio is not less than the threshold value, controls the conveying rollers 16 so as to eject the sheet P to the second ejector 20, and then the CPU 200 ends the operation.

The mode which is combined with the reading and the preliminary discrimination does not perform the image erasing, but stores the read images in the memory, and performs the judgment of whether or not the sheet P is reusable depending on the print ratio. If the CPU 200 judges that the mode which is combined with the reading and the preliminary discrimination is selected by the respective processing selection buttons 40, 41, 42, 43 of the setting items 30, 31, 32, 33 of FIG. 7, the CPU 200 stores the images in the memory at the time of reading the images by the first reader unit 13A and the second reader unit 13B as described in the above-described preliminarily discriminating mode, and judges the print ratio. The other operations are the same as in the preliminarily discriminating mode.

The mode which is combined with the preliminary discrimination and the image erasing will be described. The mode which is combined with the preliminary discrimination and the image erasing performs the judgment of whether or not the sheet P is reusable depending on the print ratio, and performs the image erasing when that the print ratio is not more than the threshold value is judged.

If the CPU 200 judges that the mode which is combined with the preliminary discrimination and the image erasing is selected by the respective processing selection buttons 40, 41, 42, 43 of the setting items 30, 31, 32, 33 of FIG. 7, the CPU 200 controls so that the pickup roller 18 supplies the sheet P from the sheet tray 22 and controls the conveying rollers 16 so as to convey the sheet P to the first conveying path 11. The CPU 200 reads the images of the sheet P by the first reader unit 13A and the second reader unit 13B and controls so as to judge the print ratio. If the CPU 200 judges that the print ratio is not less than the threshold value, controls the conveying rollers 16 so as to eject the sheet P to the second ejector 20, and then the CPU 200 ends the operation.

If the CPU 200 judges that the print ratio is smaller than the threshold value, the path changer drive controller 207 drives the path changer 17, and the conveying rollers 16 convey the sheet P from the first conveying path 11 to the second conveying path 12. The CPU performs the image erasing processing of the images on the sheet P conveyed to the second conveying path 12 by the erasure 15. The CPU 200 conveys the sheet P from the second conveying path 12 to the first conveying path 11 by the conveying rollers 16, ejects the sheet P to the first ejector 19 or the second ejector 20, and then the CPU 200 ends the operation.

The mode which is combined with the reading, the preliminary discrimination and the image erasing stores the read images in the memory, judges whether or not the sheet P is reusable depending on the print ratio, and if the print ratio is smaller than the threshold value, performs the image erasing processing. If the CPU 200 judges that the mode which is combined with the reading, the preliminarily discriminating and the cooler erasing is selected by the respective processing selection buttons 40, 41, 42, 43 of the setting items 30, 31, 32, 33 of FIG. 7, the CPU 200 stores the images in the memory at the time of reading the images by the first reader unit 13A and the second reader unit 13B as described in the above-described mode which is combined with the preliminary discrimination and the image erasing, and judges the print ratio. The other operations are the same as in the mode which is combined with the preliminary discrimination and the image erasing.

The mode which is combined with the preliminary discrimination, the image erasing and the discrimination will be described. The mode which is combined with the preliminary discrimination, the image erasing and the discrimination performs the judgment of whether or not the sheet P is reusable depending on the print ratio, and when that the print ratio is not more than the threshold value is judged, performs the image erasing, and performs the discrimination of whether or not the sheet P is reusable.

If the CPU 200 judges that the mode which is combined with the preliminary discrimination, the image erasing and the discrimination is selected by the respective processing selection buttons 40, 41, 42, 43 of the setting items 30, 31, 32, 33 of FIG. 7, the CPU 200 controls so that the pickup roller 18 supplies the sheet P from the sheet tray 22 and controls the conveying rollers 16 so as to convey the sheet P to the first conveying path 11. The CPU 200 reads the images of the sheet P by the first reader unit 13A and the second reader unit 13B, and controls so as to judge the print ratio. If the CPU 200 judges that the print ratio is not less than the threshold value, controls the conveying rollers 16 so as to eject the sheet P to the second ejector 20, and then the CPU 200 ends the operation.

If the CPU 200 judges that the print ratio is smaller than the threshold value, the path changer drive controller 207 drives the path changer 17, and the conveying rollers 16 convey the sheet P from the first conveying path 11 to the second conveying path 12. The CPU 200 performs the image erasing processing of the images on the sheet P conveyed to the second conveying path 12 by the erasure 15. The CPU 200 conveys the sheet P from the second conveying path 12 to the first conveying path 11 by the conveying rollers 16, and reads again the images of the sheet P by the first reader unit 13A and the second reader unit 13B. The CPU 200 judges whether or not the sheet P is reusable. If the sheet P is reusable, the conveying rollers 16 convey the sheet P to the first ejector 19 and then the CPU 200 ends the operation. If the sheet P is not reusable, the conveying rollers 16 convey the sheet to the second ejector 20, and then the CPU 200 ends the operation.

The mode which is combined with the reading, the preliminary discrimination, the image erasing and the discrimination stores the read images in the memory, and judges whether or not the sheet P is reusable depending on the print ratio, and if the print ratio is smaller than the threshold value, performs the image erasing processing and judges whether or not the sheet P is reusable after the image erasing. If the CPU 200 judges that the mode which is combined with the reading, the preliminary discrimination, the image erasing and the discrimination is selected by the respective processing selection buttons 40, 41, 42, 43 of the setting items 30, 31, 32, 33 of FIG. 7, the CPU 200 stores the images in the memory at the time of reading the images by the first reader unit 13A and the second reader unit 13B as described in the above-described mode which is combined with the preliminary discrimination, the image erasing and the discrimination, and judges the print ratio. The other operations are the same as in the mode which is combined with the preliminary discrimination, the image erasing and the discrimination.

In case that the mode in which the reading, the image erasing and the discrimination are combined is selected, and the sheet P is processed one by one, the first reader unit 13A and the second reader unit 13B perform alternately the image reading so as to remain the image data before image erasing and the image reading so as to discriminate whether or not the image erasing has normally been performed after erasing the images, respectively.

The operating portion 210 of the image erasing apparatus 100 can select each of the above-described modes, and thereby a user can select a desired mode. Not only the operating portion 210 of the image erasing apparatus 100 can select each mode, but the Operating portion 303 of the client PC 101 may select each mode.

The CPU 200 varies the conveying speeds of the sheet P depending on the mode respectively, when the first reader unit 13A and the second reader unit 13B read the respective images and when the erasure 15 erases the color of the images. When the erasure 15 performs the image erasing processing, if the sheet P is conveyed at a conveying speed faster than a prescribed speed, the heater 205 can not apply a sufficient amount of heat to the color material, and thereby the image erasing processing might not normally be performed. On the other hand, though maximum speeds in the reader are different depending on the material, a maximum conveying speed at the time of image reading is faster than a maximum conveying speed at the image erasing processing. For this reason, the relation between the conveying speed V1 at the time of the image erasing processing and the conveying speed V2 at the time of reading is determined as V1<V2.

Accordingly, in each of the four cases of the image erasing mode, the mode which is combined with the reading and the image erasing, the mode which is combined with the image erasing and the discrimination, and the mode which is combined with the reading, the image erasing and the discrimination, the relation between the conveying speed V1 at the time of image erasing and the conveying speed V2 at the time of reading is determined as V1<V2.

In each of the two cases of the reading mode and the discriminating mode, since the sheet P is not conveyed to the erasure 15, the sheet P is conveyed at a prescribed conveying speed which is sufficient for the reader to read the image.

In the image erasing apparatus 100 as described above, the reader to read the image so as to remain the image data in the data memory portion, and the reader to read the image so as to discriminate whether or not the image erasing has been normally performed are made a common reader, and thereby the cost can be reduced.

In addition, the mode can be selected and the conveying speeds of the sheet P are varied depending on the mode, and thereby the processing time can be reduced.

(Third Embodiment) An image erasing apparatus of a third embodiment shown in FIG. 16 to FIG. 20 performs the reading processing, the image erasing processing and the discriminating processing continuously for a plurality of sheets, and shifts the processings for each sheet to thereby perform parallel processing. In the drawings, the same symbols are given to the same constituent components as in the first embodiment. In the drawings, an arrow indicates a traveling direction of the sheet P.

In the image erasing processing of a first sheet P, the processings are performed in the following order: the reading processing by the first reader unit 13A and the second reader unit 13B, both serving as the reader, next the image erasing processing by the erasure 15, the reading processing again by the first reader unit 13A and the second reader unit 13B, and then the discriminating processing to judge whether or not the sheet P is reusable. When one sheet P is taken into account, the same processing is performed as in the flow chart shown in FIG. 12

Hereinafter, processings composed of the reading processing, the image erasing processing and the discriminating processing which are performed continuously for three sheets will be described. The preceding sheet P is determined as a first sheet P1, and the sheets conveyed succeeding to the first sheet P1 are determined as a second sheet P2 and a third sheet P3 in sequence. The first sheet P1 is supplied and is conveyed to the first conveying path 11, and then the first reader unit 13A and the second reader unit 13B perform the reading processing (FIG. 4).

Figure 16:
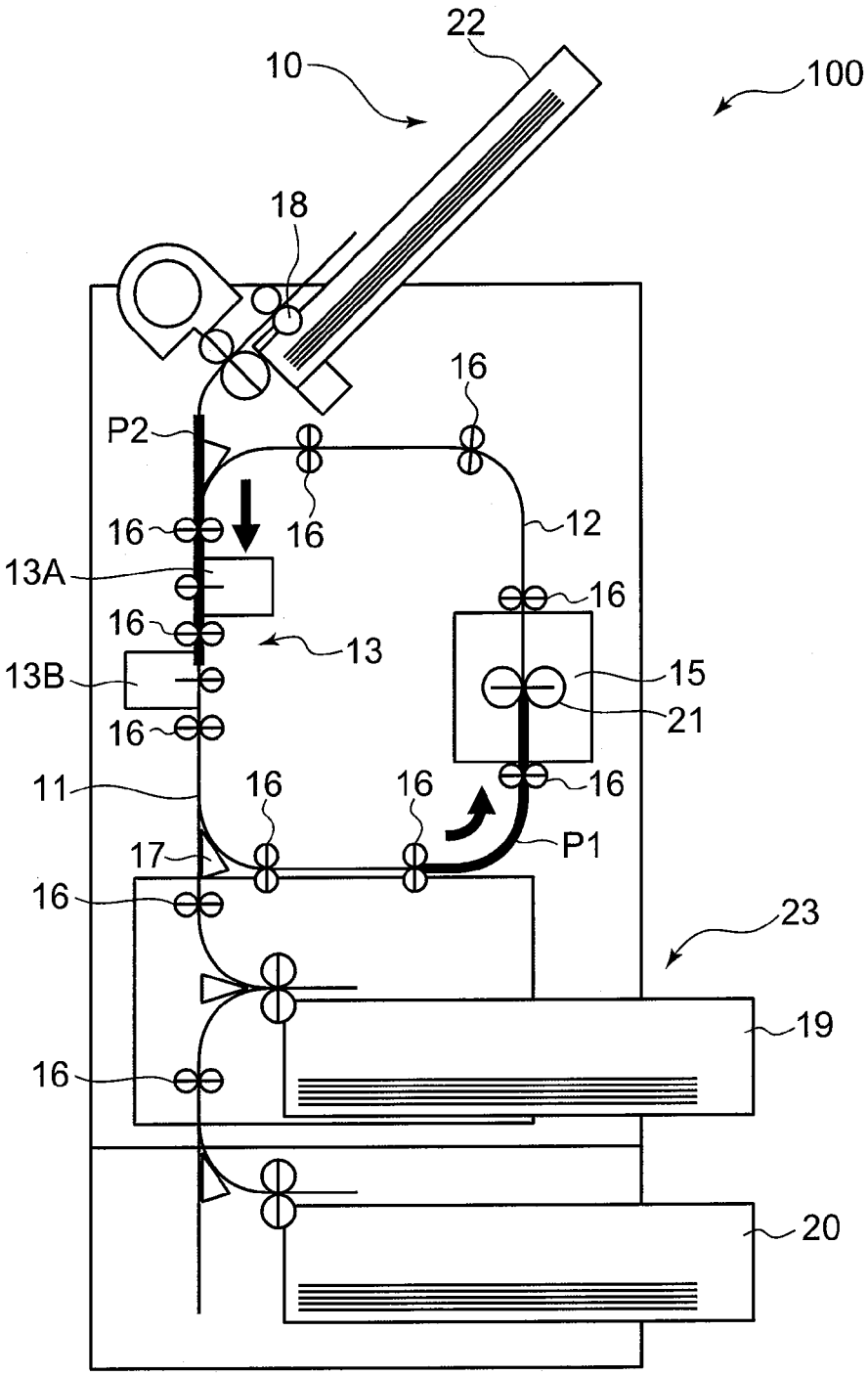
FIG. 16 is a schematic diagram showing a conveying condition of a first sheet in the second conveying path and a conveying condition of a second sheet in the first conveying path in a third embodiment.

Subsequently, as shown in FIG. 16, while the conveying rollers 16 convey the first sheet P1 to the second conveying path 12, and the erasure 15 performs the image erasing processing for the images on the sheet P1, the pickup roller 18 supplies the second sheet P2 from the sheet supply tray 22, the conveying rollers 16 convey the second sheet P2 to the first conveying path 11, and the first reader unit 13A and the second reader unit 13B perform the reading processing for the images on the second sheet P2.

Figure 17:
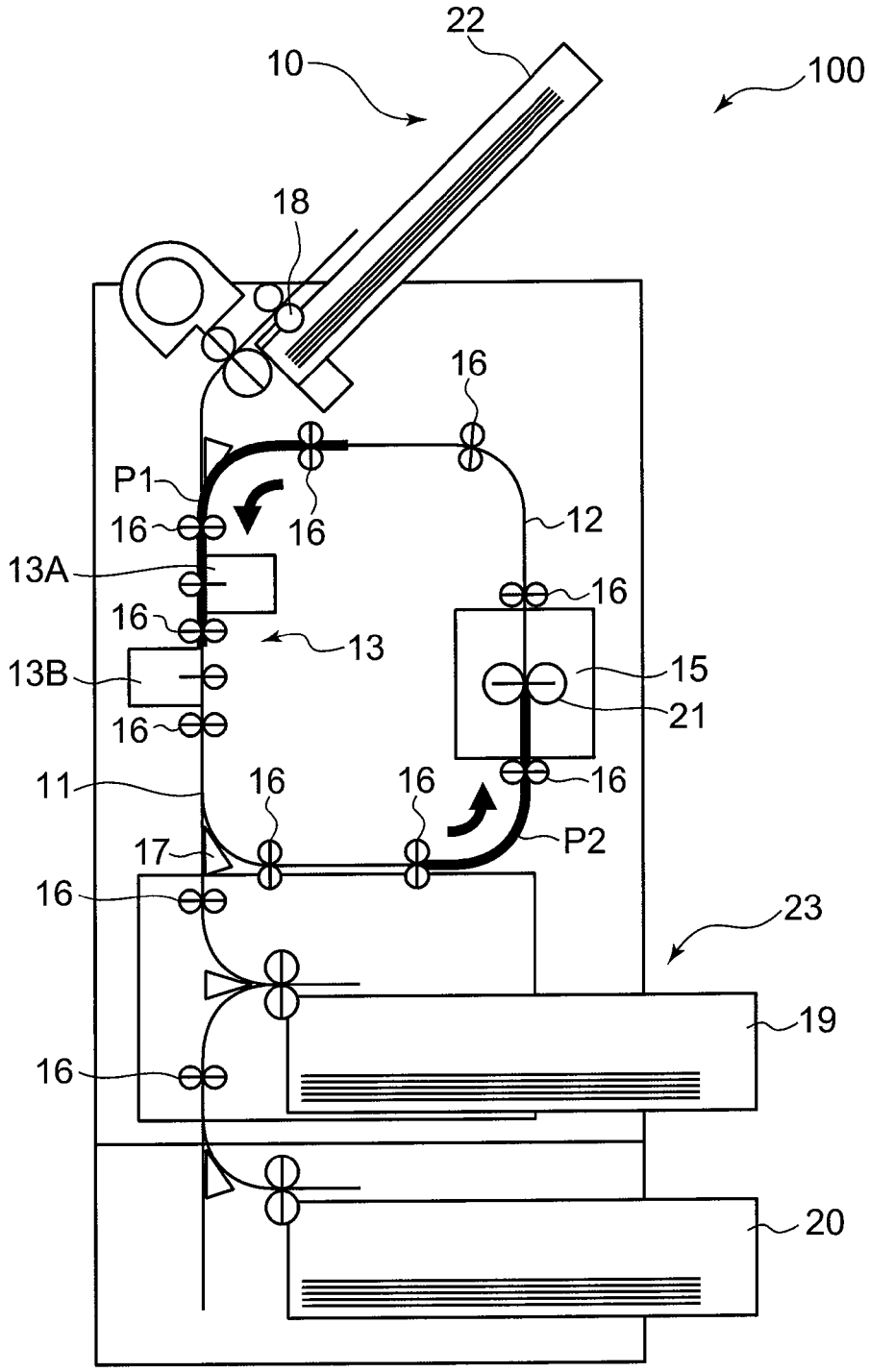
FIG. 17 is a schematic diagram showing a conveying condition of the first sheet from the second conveying path to the first conveying path and a conveying condition of the second sheet in the second conveying path in the third embodiment.

Then, as shown in FIG. 17, the conveying rollers 16 convey the first sheet P1 to the first conveying path 11, the first reader unit 13A and the second reader unit 13B read the respective images on the sheet P1, and then the CPU 200 performs the discrimination processing. While the conveying rollers 16 ejects the sheet P1 to the first ejector 19 or the second ejector 20, the conveying rollers 16 convey the second sheet P2 to the second conveying path 12 and the erasure 15 performs the image erasing processing for the image on the sheet P2.

Figure 18:
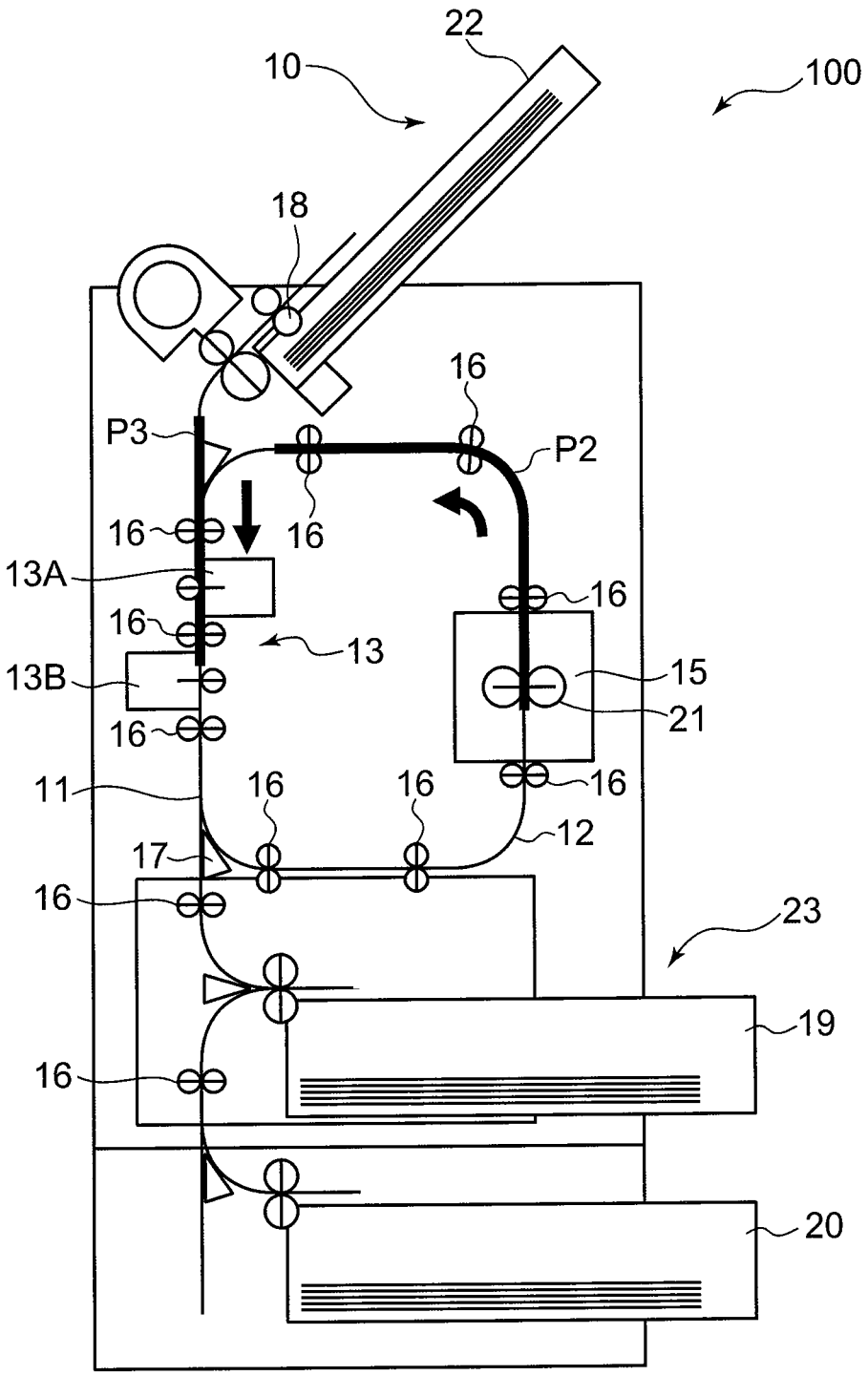
FIG. 18 is a schematic diagram showing a conveying condition of the second sheet in the second conveying path and a conveying condition of a third sheet in the first conveying path in the third embodiment.

In addition, as shown in FIG. 18, while the conveying rollers 16 convey the second sheet P2 to the second conveying path 12, and the erasure 15 performs the image erasing processing for the images on the sheet P2, the pickup roller 18 supplies the third sheet P3 from the sheet supply tray 22, the conveying rollers 16 convey the third sheet P3 to the first conveying path 11, and the first reader unit 13A and the second reader unit 13B performs the reading processing for the respective images on the sheet P3.

Figure 19:
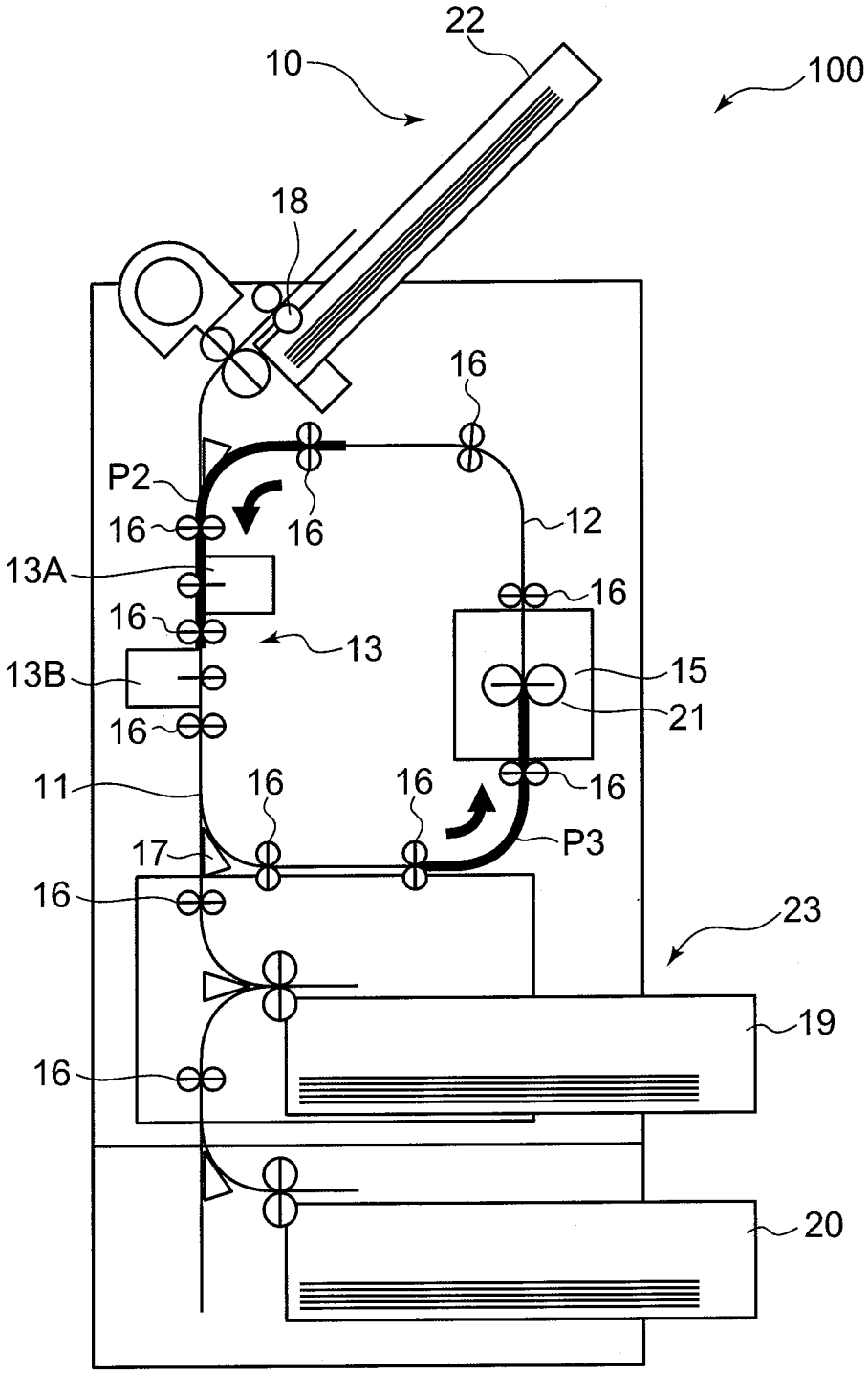
FIG. 19 is a schematic diagram showing a conveying condition of the second sheet from the second conveying path to the first conveying path and a conveying condition of the third sheet in the second conveying path in the third embodiment.

And, as shown in FIG. 19, the conveying rollers 16 convey the second sheet P2 to the first conveying path 11, the first reader unit 13A and the second reader unit 13B read the respective images on the sheet P2, and then the CPU 200 performs the discrimination processing. While the conveying rollers 16 eject the second sheet P2 to the first ejector 19 or the second ejector 20, the conveying rollers 16 convey the third sheet P3 to the second conveying path 12 and the erasure 15 performs the image erasing processing for the images on the sheet P3. After that time, the same processings as described above are performed repeatedly.

When the above-described processings are repeated, the reading processings are performed in the following order. The reading processing for the first sheet, the reading processing for the second sheet, the discriminating processing for the first sheet, the reading processing for the third sheet, and the discriminating processing for the second sheet are performed. And finally, the discriminating processing for an (N−2)th sheet, the reading processing for an Nth sheet, the discriminating processing for an (N−1)th sheet, and the discriminating processing for the Nth sheet are performed. N is an integer.

Figure 20:
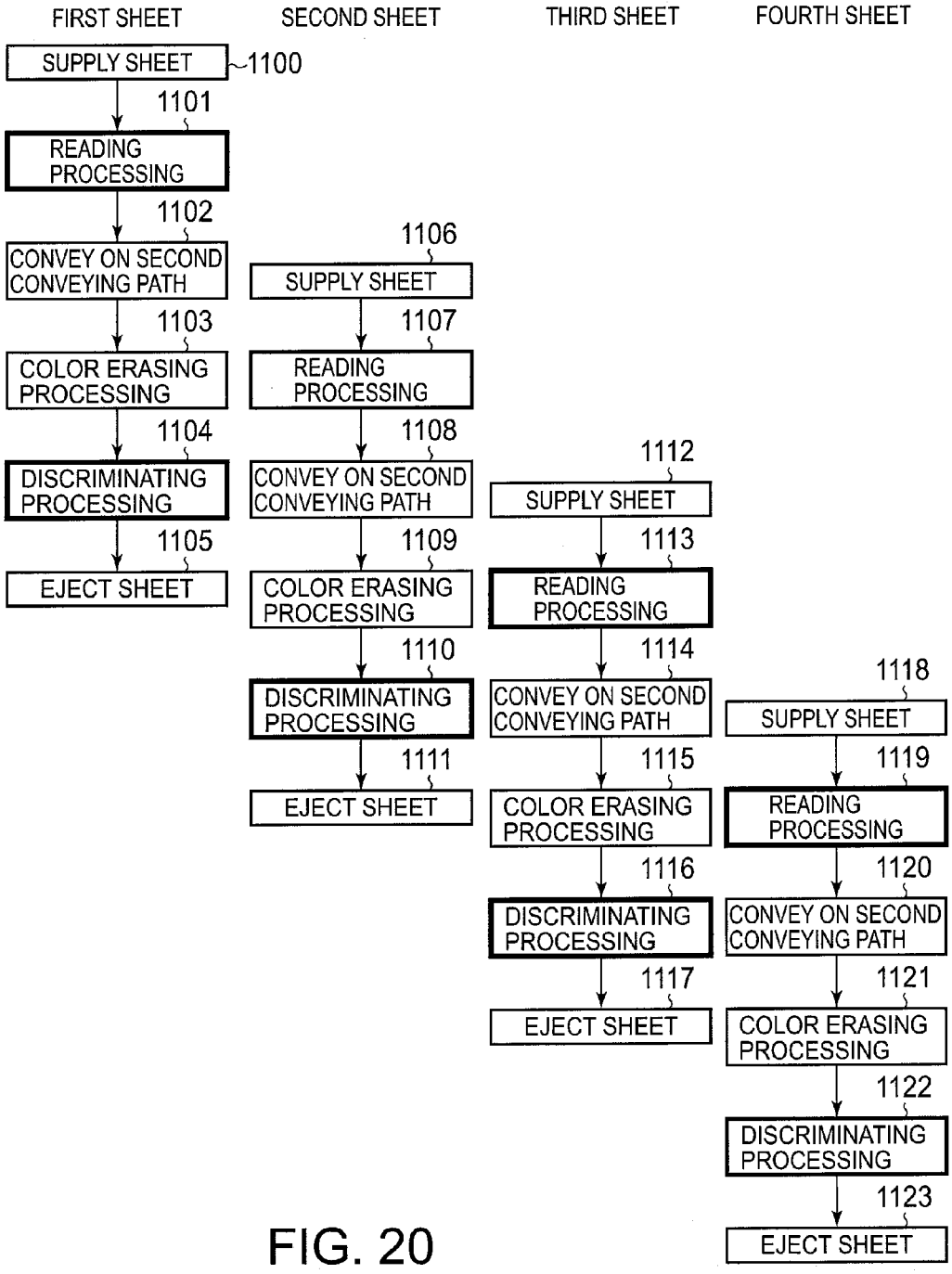
FIG. 20 is a flow chart showing a processing order when four sheets are processed in the third embodiment.

FIG. 20 shows a processing sequence when four sheets are processed. The first sheet P1 is supplied in 1100, the reading processing is performed in 1101, and the first sheet P1 is conveyed to the second conveying path 12 in 1102. Then, the image erasing processing is performed in 1103, the discriminating processing is performed in 1104, and the first sheet P1 is ejected in 1105.

While the first sheet P1 is conveyed to the second conveying path 12 in 1102, the second sheet P2 is supplied in 1106, and while the image erasing processing is performed for the first sheet P1 in 1103, the reading processing is performed for the second sheet P2 in 1107. While the discriminating processing is performed for the first sheet P1 in 1104, the second sheet P2 is conveyed to the second conveying path 12 in 1108, and while the first sheet P1 is ejected in 1105, the image erasing processing is performed for the second sheet P2 in 1109. After that time, the discriminating processing is performed for the second sheet P2 in 1110, and then the second sheet P2 is ejected in 1111.

While the discriminating processing is performed for the first sheet P1 in 1104 and the second sheet P2 is conveyed to the second conveying path 12 in 1108, the third sheet P3 is supplied in 1112. While the first sheet P1 is ejected in 1105 and the image erasing processing is performed for the second sheet P2 in 1109, the reading processing is performed for the third sheet P3 in 1113. While the discriminating processing is performed for the second sheet P2 in 1110, the third sheet P3 is conveyed to the second conveying path 12. While the second sheet P2 is ejected in 1111, the image erasing processing is performed for the third sheet P3 in 1115. After that time, the discriminating processing is performed for the third sheet P3 in 1116, and then the third sheet P3 is ejected in 1117.

While the discriminating processing is performed for the second sheet P2 in 1110 and the third sheet P3 is conveyed to the second conveying path 12 in 1114, a fourth sheet P4 is supplied in 1118. While the second sheet P2 is ejected in 1111 and the image erasing processing is performed for the third sheet P3 in 1115, the reading processing is performed for the fourth sheet P4 in 1119. While the discriminating processing is performed for the third sheet P3 in 1116, the fourth sheet P4 is conveyed to the second conveying path 12 in 1120. While the third sheet P3 is ejected in 1117, the image erasing processing is performed for the fourth sheet P4 in 1121. After that time, the discriminating processing is performed for the fourth sheet P4 in 1122, and then the fourth sheet P4 is ejected in 1123.

When the processings for the four sheets are performed, the reading processings are performed in the following order. The reading processing for the first sheet, the reading processing for the second sheet, the discriminating processing for the first sheet, the reading processing for the third sheet, the discriminating processing for the second sheet, the reading processing for the fourth sheet, the discriminating processing for the third sheet, and the discriminating processing for the fourth sheet are performed in this order.

The operating portion 210 of the image erasing apparatus 100 can select each of the above-described modes, and a user can select a desired mode. Not only the operating portion 210 of the image erasing apparatus 100 can select each mode, but the operating portion 303 of the client PC 101 may select each mode.

The CPU 200 controls the first reader unit 13A and the second reader unit 13B, the erasure 15 and the path changer 17 depending on the processing mode. In addition, in case that the processing mode which does not require the erasure 15 is selected, the CPU 200 controls such that the sheet P is ejected without being conveyed to the erasure 15. That is, in the case of the reading mode and the discriminating mode, the CPU 200 controls such that the sheet P is ejected without being conveyed to the second conveying path 12.

The conveying speeds of the sheet P may be varied depending on the mode, when the first reader unit 13A and the second reader unit 13B read the respective images and when the erasure 15 erases the color of the images, respectively. When the erasure 15 performs the image erasing processing, if the sheet P is conveyed at a conveying speed faster than a prescribed speed, the heater 205 can not apply a sufficient amount of heat to the color material, and thereby the image erasing processing might not normally be performed. On the other hand, though maximum speeds in the reader are different depending on the material, a maximum conveying speed at the time of image reading is faster than a maximum conveying speed at the image erasing processing. For this reason, the relation between the conveying speed V1 in the erasure 15 and the conveying speed V2 in the reader is determined as V1<V2.

Accordingly, in each of the four cases of the image erasing mode, the mode which is combined with the reading and the image erasing, the mode which is combined with the image erasing and the discrimination, and the mode which is combined with the reading, the image erasing and the discrimination, the relation between the conveying speed V1 in the erasure 15 and the conveying speed V2 in the reader is determined as V1<V2.

In each of the two cases of the reading mode, and the discriminating mode, since the sheet P is not conveyed to the erasure 15, the sheet P is conveyed at the prescribed conveying speed which is sufficient for the reader to read the image.

In the image erasing apparatus 100 as described above, the reader to read the image so as to remain the image, and the reader to read the image so as to discriminate whether or not the image erasing has normally been performed are made a common reader, and thereby the cost can be reduced. In addition, the mode can be selected, and thereby the processing time can be reduced.

In addition, if the reader processes the second sheet P2 after having processed the first sheet P1, much processing time will be required. But in the above-described image erasing apparatus 100, the processings are shifted for each sheet and the parallel processings are performed, and thereby the processing time can be reduced.

The conveying speeds of the sheet P may be varied, when the reader reads the images and when the erasure 15 erases the color of the images, respectively. When the erasure 15 performs the image erasing processing, if the sheet P is conveyed at a conveying speed faster than a prescribed speed, the heater 205 can not apply a sufficient amount of heat to the color material, and thereby the image erasing processing might not normally be performed. On the other hand, though maximum speeds in the reader are different depending on the material, a maximum conveying speed at the time of image reading is faster than a maximum conveying speed at the image erasing processing. For this reason, the relation between the conveying speed V1 at the time of the image erasing processing and the conveying speed V2 at the time of reading is determined as V1<V2.

On the other hand, when the reading processing is performed without performing the erasing processing, since it is not necessary to make the conveying speed V2 at the time of reading equal to the conveying speed V1 of the erasure 15 at the time of the image erasing processing, the sheet P is conveyed through the erasure 15 at the speed V1≥V2, and thereby the processing can be speeded up.

(Fourth Embodiment) An image erasing apparatus 100 of a fourth embodiment will be described. In the drawings, the same symbols are given to the same constituent components as in the above-described embodiments.

Figure 21:
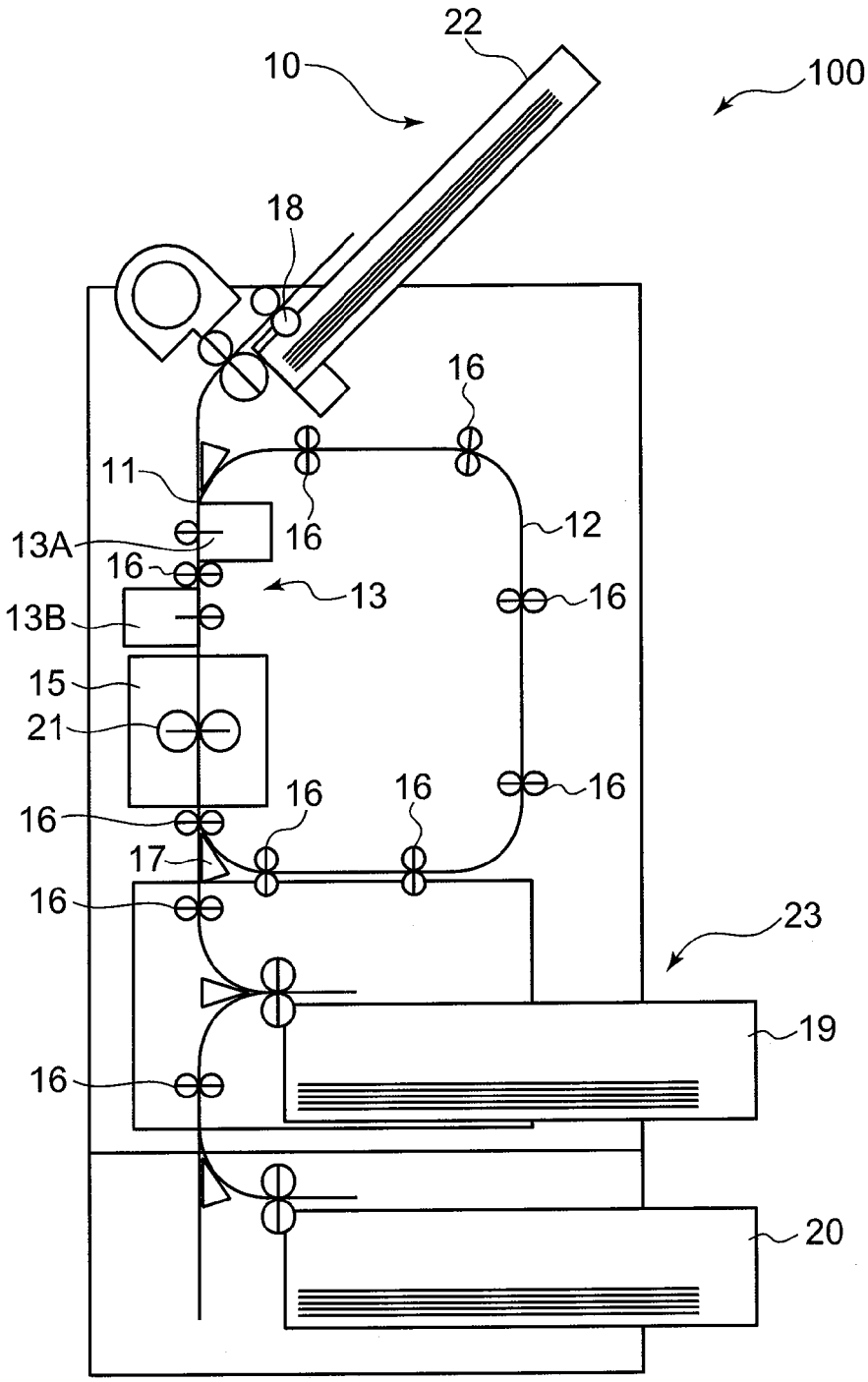
FIG. 21 is a configuration diagram of an image erasing apparatus in a fourth embodiment.

FIG. 21 is a configuration diagram of the image erasing apparatus 100 in the fourth embodiment. The erasures 15 of the first embodiment and the second embodiment are respectively located along the second conveying path 12. But, in the fourth embodiment, the erasure 15 is located in the first conveying path 11 between the reader 13 and the path changer 17 at the downstream side of the reader 13 in the sheet conveying direction.

The CPU 200 varies the relation between the speed V1 when the sheet P is conveyed through the erasure 15 and the speed V2 when conveyed through the first reader unit 13A and the second reader unit 13B depending on the mode. In the case of the image erasing mode, and in the case of the mode which is combined with the reading and the image erasing, the relation between the speed V1 when the sheet P is conveyed through the erasure 15 and the speed V2 when conveyed through the first reader unit 13A and the second reader unit 13B is determined as V1<V2.

In addition, in each of the cases of the reading mode and the discriminating mode where the image erasing processing is not performed, since it is not necessary to make the speed V2 equal to the speed V1 when the sheet P is conveyed through the erasure 15, the sheet P is conveyed through the erasure 15 at the speed V1=V2, and thereby the processing can be speeded up. In addition, if the speed V1 when the sheet P is conveyed through the erasure 15 can be made faster compared with the speed V2 when conveyed through the reader units 13A, 13B, the relation may be determined as V1>V2.

Accordingly, in the case of the reading mode, and in the case of the discriminating mode, the relation between the speed V1 when the sheet P is conveyed through the erasure 15 and the speed V2 when conveyed through the reading units 13A, 13B is determined as V1≥V2. In addition, the relation between the speed V1 when the sheet P is conveyed through the erasure 15 and the speed V2 when conveyed through the reading units 13A, 13B may be varied depending on the temperature of the erasure 15.

In the case of the mode which is combined with the image erasing and the discrimination, and in the case of the mode which is combined with the reading, the image erasing and the discrimination, the sheet P is conveyed from the first conveying path 11 to the second conveying path 12, and then is conveyed from the second conveying path 12 to the first conveying path 11 again. Accordingly, when the sheet P is conveyed on the first conveying path 11 at a first time, the relation between the speed V1 when the sheet P is conveyed through the erasure 15 and the speed V2 when conveyed through the reader units 13A, 13B is determined as V1<V2. In case that the sheet P is conveyed again on the first conveying path 11 via the second conveying path 12, the relation between a speed V3 when the sheet P is conveyed through the erasure 15 and a speed V4 when conveyed through the reader units 13A, 13B is determined as V3≥V4.

In the image erasing apparatus 100 as described above, the reader to read the image so as to remain the image, and the reader to read the image so as to discriminate whether or not the image erasing has normally been performed are made a common reader, and thereby the cost can be reduced.

In addition, the mode is selected and the conveying speeds of the sheet P are made different depending on the mode, and thereby the processing time can be reduced. In addition, since the first conveying path 11 has the erasure 15, in the case of the image erasing mode, and in the case of the mode which is combined with the reading and the image erasing, the sheet P can be processed without being conveyed on the second conveying path 12, and thereby the processing time can be reduced.

(Fifth Embodiment) In an image erasing apparatus 100 of a fifth embodiment, the first conveying path 11 has the erasure 15 at the upstream side of the first reader unit 13A and the second reader unit 13B. The image erasing apparatus 100 has a plurality of processing modes, and varies the relation between the speed V1 when the sheet P is conveyed through the erasure 15 and the speed V2 when conveyed through the reader 13 depending on the mode. In the drawings, the same symbols are given to the same constituent components as in the first embodiment.

Figure 22:
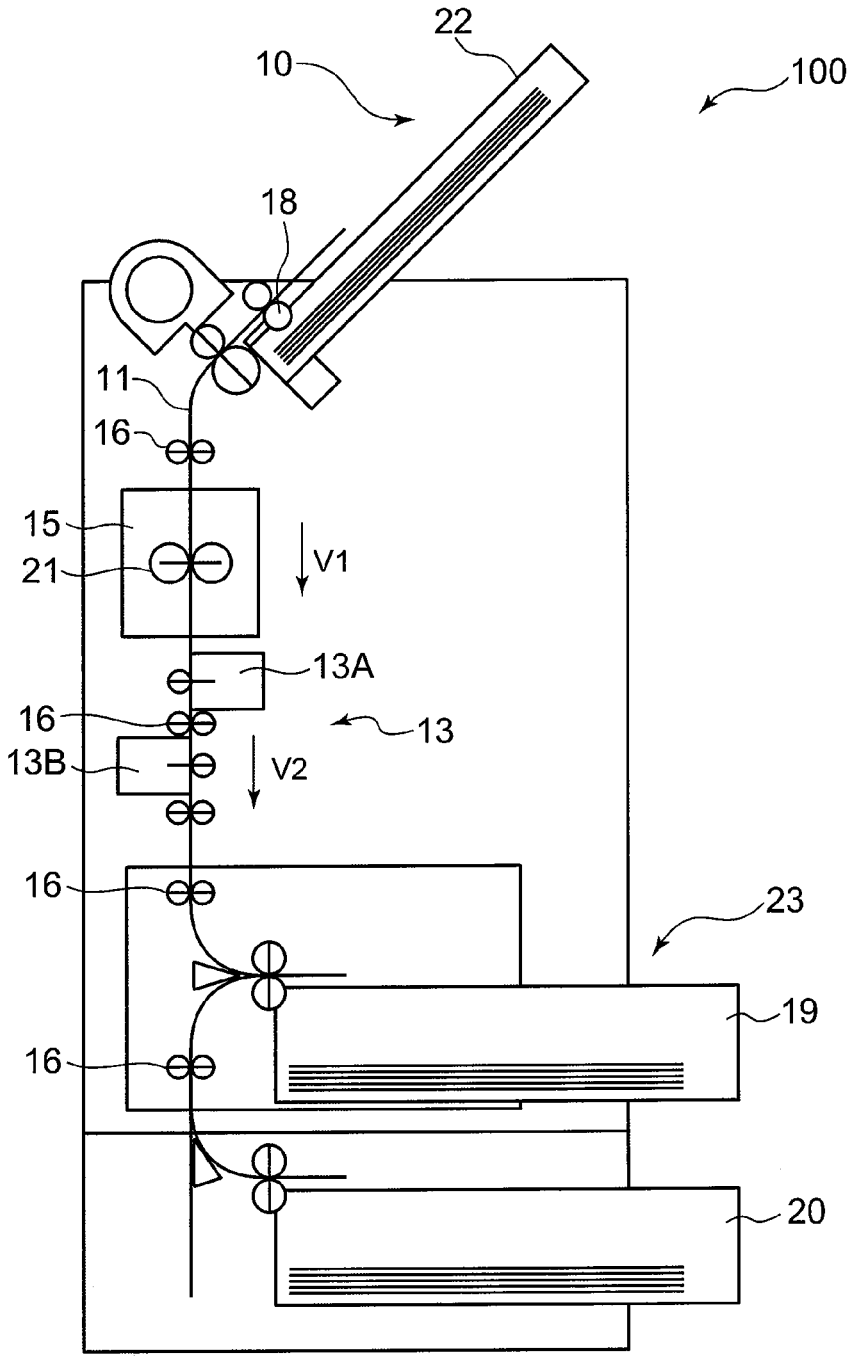
FIG. 22 is a configuration diagram of an image erasing apparatus in a fifth embodiment.

FIG. 22 is a configuration diagram of the image erasing apparatus 100 in the fifth embodiment. Each of the first embodiment, the second embodiment, the third embodiment and the fourth embodiment is composed of a loop structure having the second conveying path 12. But the fifth embodiment is not composed of a loop structure to branch from the first conveying path and to merge with the first conveying path again.

The CPU 200 varies the relation between the speed V1 when the sheet P is conveyed through the erasure 15 and the speed V2 when conveyed through the first reader unit 13A and the second reader unit 13B depending on the mode. In each of the cases of the image erasing mode, the mode which is combined with the reading and the image erasing, the mode which is combined with the image erasing and the discrimination, and the mode which is combined with the reading, the image erasing and the discrimination, the relation between the speed V1 when the sheet P is conveyed through the erasure 15 and the speed V2 when conveyed through the first reader unit 13A and the second reader unit 13B is determined as V1<V2.

In addition, in each of the cases of the reading mode and the discriminating mode where the image erasing processing is not performed, since it is not necessary to make the speed V2 equal to the speed V1 when the sheet P is conveyed through the erasure 15, the sheet P is conveyed through the erasure 15 at the speed V1=V2, and thereby the processing can be speeded up. In addition, if the speed V1 when the sheet P is conveyed through the erasure 15 can be made faster compared with the speed V2 when conveyed through the first reader unit 13A and the second reader unit 13B, the relation may be determined as V1>V2. Accordingly, in the case of the reading mode, and in the case of the discriminating mode, the relation between the speed V1 when the sheet P is conveyed through the erasure 15 and the speed V2 when conveyed through the reading units 13A, 13B is determined as V1≥V2.

In addition, the relation between the speed V1 when the sheet P is conveyed through the erasure 15 and the speed V2 when conveyed through the reading units 13A, 13B may be varied depending on the temperature of the erasure 15. The erasure 15 applies heat at the time of the image erasing processing, and the temperature thereof does not necessarily drop immediately even if the heat source is made OFF. In case that the sheet P is processed in the reading mode immediately after the sheet P has been image erased in the image erasing mode, for example, there may be a case that the temperature of the erasure 15 has not dropped completely. If the sheet P is conveyed and heat is applied to the color material in such a condition, the print might be image erased.

For this reason, in case that the sheet P is processed in the reading mode, a temperature detecting portion 212 detects the temperature of the heater 205 of the erasure 15, and if the temperature of the erasure 15 is not more than a prescribed value, the relation between the speed V1 when the sheet P is conveyed through the erasure 15 and the speed V2 when conveyed through the reader units 13A, 13B is determined as V1=V2. On the other hand, if the temperature of the erasure 15 is larger than the prescribed value, the relation between the speed V1 when the sheet P is conveyed through the erasure 15 and the speed V2 when conveyed through the reader units 13A, 13B is determined as V1>V2.

In the image erasing apparatus 100 as described above, the reader to read the image so as to remain the image and the reader to read the image so as to discriminate whether or not the image erasing has normally been performed are made a common reader, and thereby the cost can be reduced.

In addition, the mode is selected and the conveying speeds of the sheet P are made different depending on the mode, and thereby the processing time can be reduced. In addition, in case that the temperature of the erasure 15 has not dropped completely, the relation of the speed V1 when the sheet P is conveyed through the erasure 15 and the speed V2 when conveyed through the reader units 13A, 13B is determined as V1>V2, and the conveying speed in the erasure 15 is made faster, and thereby the print can be prevented from being image erased.

In the description of the above-described embodiments, "the image erasing processing" has been described so as to mean to erase the color of the image as the image erasing apparatus, but it also has meaning to erase the image. The image erasing apparatus described in the present embodiments is not limited to an apparatus which erases the color of an image with heat. An apparatus to erase the color of an image on a sheet with light irradiation or an apparatus to erase an image formed on a special sheet may be used. Or, an apparatus to remove (eliminate) an image on a sheet may be used, or a configuration to make an image invisible so as to make a sheet reusable may be used.

While certain embodiments have been described, those embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image erasing apparatus, comprising:

a sheet supply portion configured to supply a sheet;

an ejector to which the sheet is ejected;

a first conveying path configured to convey the sheet from the sheet supply portion toward the ejector;

a reader arranged on the first conveying path configured to read a surface of the sheet;

a second conveying path that branches from the first conveying path at a first position downstream of the reader in a sheet conveying direction and that merges with the first conveying path at a second position between the sheet supply portion and the reader;

an erasing unit arranged on the second conveying path configured to erase an image on the sheet formed with image erasable material; and a switching portion arranged at the first position on the first conveying path at a downstream side of the reader in a sheet conveying direction configured to switch a conveyance path of the sheet between the first conveying path towards the ejector and the second conveying path towards the erasing unit.

2. The apparatus of claim 1, further comprising: a controller configured to control the switching portion to switch the conveyance path of the sheet.

3. The apparatus of claim 2, wherein the controller controls the switching portion so that the sheet which the reader has read at a first time is conveyed on the second conveyance path towards the erasing unit, and the sheet which the reader has read at a second time is conveyed on the first conveyance path to the ejector.

4. The apparatus of claim 3, wherein the controller stores, in a memory portion, image data of the surface of the sheet read by the reader before the image is erased by the erasing unit.

5. The apparatus of claim 4, wherein the controller is further configured to determine whether or not the sheet is reusable based on image data of the surface of the sheet read by the reader after the image is erased by the erasing unit.

6. The apparatus of claim 5, wherein the ejector includes a first ejector to which a reusable sheet is ejected and a second ejector to which a non-reusable sheet is ejected.

7. The apparatus of claim 5, wherein the controller controls a processing order whereby a first sheet is read first, a second sheet is read second, the first sheet is determined to be reusable or non-reusable third, a third sheet is read fourth, and the second sheet is determined to be reusable or non-reusable fifth.

8. The apparatus of claim 2, further comprising:

an operating portion configured to receive a selection of a processing mode;

wherein the controller controls the switching portion depending on the processing mode selected from a plurality of processing modes.

9. The apparatus of claim 8, wherein if the selected processing mode is a first mode in which the surface the sheet is read by the reader and not erased, the controller controls the switching portion so that the conveyance path of the sheet is the first conveying path towards the ejector, and stores, in a memory portion, image data of the surface of the sheet read by the reader.

10. The apparatus of claim 9, wherein if the selected processing mode is a second mode in which it is determined whether or not the sheet is reusable but image data of the surface read by the reader is not stored, the controller controls the switching portion so that the conveyance path of the sheet is the first conveying path towards the ejector, and determines whether or not the sheet is reusable based on image data of the surface of the sheet read by the reader.

11. The apparatus of claim 9, wherein if the selected processing mode is a third mode in which the image is erased or a fourth mode in which the surface of the sheet is read by the reader and it is determined whether or not the sheet is reusable, the controller controls the switching portion so that the conveyance path of the sheet is the second conveying path, and after the sheet is conveyed through the erasing unit, the controller controls the switching portion so that the conveyance path of the sheet is the second conveying path towards the ejector.

12. An image erasing method, comprising:

supplying a sheet from a sheet supply portion;

ejecting the sheet to an ejector;

reading, with a reader, a surface of the sheet arranged on a first conveying path that conveys the sheet from the sheet supply portion toward the ejector;

conveying the sheet to a second conveying path that branches from the first conveying path at a first position downstream of the reader in a sheet conveying direction and that merges with the first conveying path at a second position between the sheet supply portion and the reader;

erasing an image formed on the sheet with image erasable material with an erasing unit arranged on the second conveying path; and changing a conveyance path of the sheet from the second conveying path towards the erasing unit to the first conveying path towards the ejector.

13. The method of claim 12, further comprising:

conveying the sheet which the reader has read the surface of at a first time in the direction of the erasing unit; and conveying the sheet which the reader has read at a second time in the direction of the ejector.

14. The method of claim 13, further comprising:

storing image data of the surface of the sheet read by the reader before the image is erased by the erasing unit.

15. The method of claim 14, further comprising:

determining whether or not the sheet is reusable based on image data of the surface of the sheet read by the reader after the image is erased by the erasing unit; and sorting the sheet based on the determination.

16. The method of claim 15, further comprising, in order:

reading an image on a first sheet by the reader;

reading an image on a second sheet by the reader;

determining whether the first sheet is reusable or not based on the image read on the first sheet by the reader;

reading an image on a third sheet;

determining whether the second sheet is reusable or not based on the image read on the second sheet by the reader.

17. The method of claim 15, further comprising:

changing, prior to said conveying, the conveyance path of the sheet conveyed from the sheet supply portion to the second conveying path.

18. The method of claim 12, further comprising:

receiving a selection of a processing mode in which the surface of the sheet is read by the reader but not erased; and storing, in a memory portion, image data read by the reader.

19. The method of claim 12, further comprising:

receiving a selection of a processing mode in which it is determined whether or not the sheet is reusable; and determining whether or not the sheet is reusable based image data read by the reader.

20. An image erasing apparatus, comprising:

sheet supply means for supplying a sheet;

ejecting means to which the sheet is ejected;

first conveying means for conveying the sheet from the sheet supply means to the ejecting means;

reading means arranged on the first conveying means for reading a surface of the sheet;

second conveying means that branches from the first conveying means at a first position downstream of the reading means in a sheet conveying direction and that merges with the first conveying means at a second position between the sheet supply means and the reading means, the second conveying means for conveying the sheet from the first position to the second position;

image erasing means arranged on the second conveying means for erasing an image formed on the sheet with image erasable material; and switching means arranged at the first position on the first conveying means at a downstream side of the reading means in a sheet conveying direction for switching a conveyance path of the sheet between the first conveying means towards the ejecting means and the second conveying means towards the image erasing means.

* * * * *

UNITED STATES PATENT AND TRADEMARK OFFICE

CERTIFICATE OF CORRECTION

PATENT NO. : 8,743,164 B2
APPLICATION NO. : 13/486769
DATED : June 3, 2014
INVENTOR(S) : Ken Iguchi et al.

It is certified that error appears in the above-identified patent and that said Letters Patent is hereby corrected as shown below:

Title Page, Item (75) Inventors:
Please delete "Chiaki Ilzuka" and replace with "Chiaki Iizuka".

Signed and Sealed this
Second Day of August, 2016

Michelle K. Lee

Michelle K. Lee
*Director of the United States Patent and Trademark Office*